US005515916A

United States Patent [19]

Haley

[11] Patent Number: 5,515,916

[45] Date of Patent: May 14, 1996

[54] BLOWOUT PREVENTER

[75] Inventor: Thomas D. Haley, Cypress, Tex.

[73] Assignee: Stewart & Stevenson Services, Inc., Houston, Tex.

[21] Appl. No.: 398,347

[22] Filed: Mar. 3, 1995

[51] Int. Cl.[6] ..... E21B 33/06

[52] U.S. Cl. ..... 166/55

[58] Field of Search ..... 166/55; 251/1.3; 277/129

[56] References Cited

U.S. PATENT DOCUMENTS

| | | | |
|---|---|---|---|
| 2,969,838 | 1/1961 | Wilde | 166/55 |
| 3,561,526 | 2/1971 | Williams, Jr. et al. | 166/55 |
| 3,736,982 | 6/1973 | Vujasinovic | 166/55 |
| 3,817,326 | 6/1974 | Meynier, III | 166/55 |
| 3,946,806 | 3/1976 | Meynier, III | 166/55 |
| 4,132,265 | 1/1979 | Williams, Jr. | 166/55 |
| 4,132,266 | 1/1979 | Randall | 166/55 |
| 4,132,267 | 1/1979 | Jones | 166/55 |
| 4,240,503 | 12/1980 | Holt, Jr. et al. | 166/55 |
| 4,313,496 | 2/1982 | Childs et al. | 166/55 |
| 4,341,264 | 7/1982 | Cox et al. | 166/55 |
| 4,347,898 | 9/1982 | Jones | 166/55 |
| 4,537,250 | 8/1985 | Troxell, Jr. | 166/55 |
| 4,540,046 | 9/1985 | Granger et al. | 166/55 |
| 4,646,825 | 3/1987 | Van Winkle | 166/55 |
| 4,647,002 | 3/1987 | Crutchfield | 251/1.3 |
| 5,064,164 | 11/1991 | Le | 251/1.1 |

*Primary Examiner*—Hoang C. Dang

*Attorney, Agent, or Firm*—Frank S. Vaden; Marvin B. Eickenroht; Jennings B. Thompson

[57] ABSTRACT

There are disclosed rams for blowout preventers having blades on their inner ends in position to shear or sever a pipe or other object extending within the bore of the preventer housing as the rams are moved within guideways intersecting the bore from outer positions, in which the bore is open, to inner positions in which shear edges on opposed faces of the blades pass over another. The rams also carry packing for sealing with respect to the guideways in which they move as well as with respect to one another to close off the bore following shearing of the object.

16 Claims, 12 Drawing Sheets

FIG.1
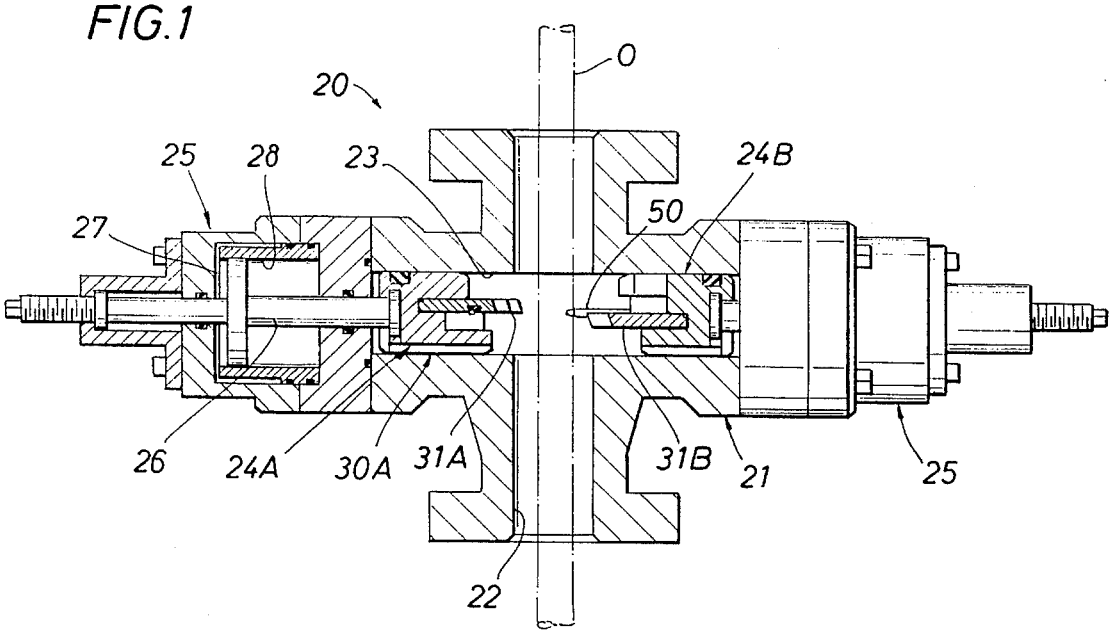
FIG.9
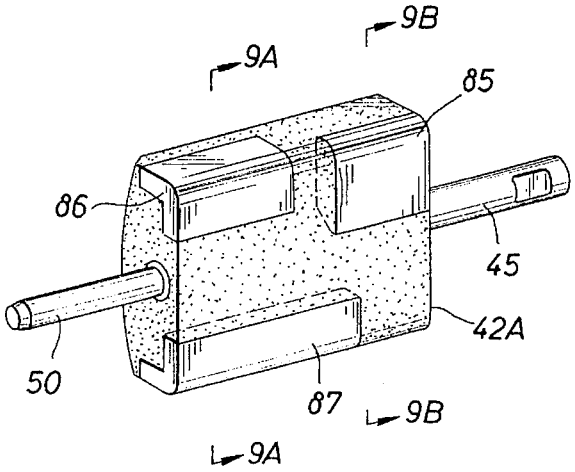
FIG.9A
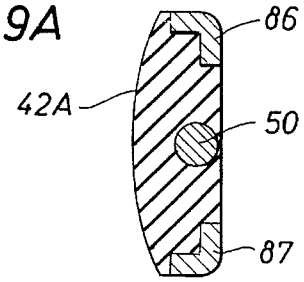
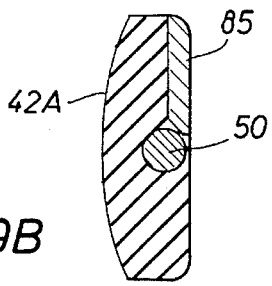
FIG.9B 37
38
32
24B
36
43B
36B
42A
35B
45
49
60B
30B
46
50
45
36D
44B
36E
41A
50
33
35A
31B

BLOWOUT PREVENTER

This invention relates generally to blowout preventers, and, more particularly, to improvements in rams for blowout preventers which have blades on their inner ends in position to shear or sever a pipe or other object extending within the bore of the preventer housing as the rams are moved within guideways intersecting the bore from outer positions, in which the bore is open, to inner positions in which shear edges on opposed faces of the blades pass over another. In one of its aspects, the invention relates to rams of this type which also carry packing for sealing with respect to the guideways in which they move as well as with respect to one another to close off the bore following shearing of the object.

As well known in the art, a "stack" of blowout preventers are installed on the head of a well bore during drilling of the well and/or during workover operations. In the case of a ram type preventer, cut out portions in the inner edges of the "pipe" rams adapted to fit about a pipe or thus seal with respect to one another as well as the pipe in the bore, which often is tubing extending for a considerable depth into the well bore. In some cases, the "stack" also includes so-called "blind" rams whose inner edges engage for their full width to close an open bore. In still other cases, the rams have shear rams of the type described which permit the pipe or outer object to be sheared in the case of an emergency, which doesn't leave time for the pipe or other object to be pulled, thereby permitting the wellhead to be removed along with the upper portion of the cut pipe.

It is, of course, desirable that the shear rams have the capability of closing the bore after the object is sealed, thus providing the dual purpose of shear and blind rams. Also, it is often desirable, when a well is to be reopened, to lower another pipe onto the upper end of the lower portion of the sheared pipe so as to form a sealed connection therebetween and thus establish circulation from and to the wellhead. To facilitate this, it is desirable to leave the upper end as close to round as possible. For this purpose, it has often been the practice to provide the shear edges with cut outs to match the diameter of the pipe, which requires replacement of the ram each time a different object is to be sheared. In other cases, crushing of the pipe is minimized by the use of rams having opposed "V" shaped shear edges.

The advent and increasing popularity of drilling wells with horizontal legs or lower extensions has in turn brought on an increased use of coil tubing. The relatively thin diameter and flexibility of coil tubing, compared to conventional tubing, often makes it more difficult to shear. That is, such tubing is more difficult to maintain centered in the bore and has a tendency to be pushed to one side of the shear blades and thus out from between the shear edges. This is even a greater problem when the object in the bore includes wire or other flexible small diameter lines, or even bundles of same.

For this reason, it has been proposed to widen the blades so that the opposite ends of their shear blades extend beyond the bore of the preventer on each side. Also, their shear edges preferably are V-shaped to form a diminishing diamond shaped opening between them as the side edges of the rams begin to overlap. On the other hand, in order to keep the preventer at a reasonable size, it is not practical for the side edges of the blades on opposed rams to be of such size as to overlap in the outer, bore opening position of the rams.

As shown in U.S. Pat. No. 4,313,496, it has been proposed to provide inwardly extending arms on the outer sides of each ram for overlapping complementary arms on the other ram. As shown, the arms are closely received between the sides of the shear blades and inner extensions of the ram guideways which intersect the bore of the preventer housing.

Among other things, the arms add considerably to the expense of the rams, and, perhaps more importantly, occupy space in which side packers could otherwise be mounted on the sides of the rams. Hence, the preventer does not have the ability to close off the well bore, and another preventer with blind rams would have to be provided for this purpose. As expressed in the patent, the arms are also intended to keep the blade faces from spreading in the process of shearing the object, which of course would be a particular problem if the object to be sheared is sufficiently small and/or flexible that it might be folded between the faces of the blades.

It has been proposed to seal between the shear blades by means of packing carried across the inner end of each ram for sealably engaging the inner end on the other ram as they are moved inwardly to shear a pipe. Subsequently, however, it was proposed to cause the blades to seal with respect to one another following shearing by means of a seal strip carried in face of one blade, preferably the lower face of the upper blade, for sealably engaging the face of the other blade. Thus, the ends of the cross seal extended to side packers of the ram so that they were activated upon engagement of the side packers with one another following shearing of the pipe. Nevertheless, as a practical manner, to insure a seal, the outer face of the strip would have to be at least flush with and preferably protrude from the blade, and thus in position to be damaged by the shear edge of the other blade.

Due to this concern as well as the above noted tendency of the faces of the blades to separate, it was proposed in U.S. Pat. No. 4,347,898 to provide one ram with ramps and the other with shoulders arranged to slide over the ramps in order to move the faces toward tight engagement, and thus activate the cross seal, only upon shearing of the blade. This however requires very concise machinery to meet close tolerances.

It is therefore the primary object of this invention to provide a blowout preventer having shear rams which overcome many if not all these and other problems.

A still further object is to provide such rams which are of relatively simple but sturdy and inexpensive construction and capable of shearing objects of widely varying sizes and degrees of compressibility including even solid bars.

Another object is to provide such rams which include the ability to close the bore, following shearing, without unduly increasing their size and thus the cost of the preventer.

Still another object is to provide such rams which are of such construction as to minimize the possibility of the object being moved laterally out from between the shear edges or of being crushed to a shape in which it is difficult to lower and seal another pipe about its upper end.

A further object is to provide such rams in which a cross seal strip on one blade face is of such construction and so arranged as to avoid being damaged by the other blade.

These and other objects are accomplished, in accordance with the illustrated embodiment of the present invention, by an assembly which includes, as in prior blowout preventers of this type, a pair of rams each having a body closely slidable in a guideway of the preventer housing for movement toward and away from the other between inner and outer positions, an upper shear blade carried by the body of a first ram, and a lower shear blade carried by the body of a second ram and having a shearing edge on the inner end on its upper face for moving past a shearing edge on the inner end of the lower face of the upper blade to shear an object in bore as the rams are moved from their outer toward inner positions.

In accordance with one novel aspect of the invention, however, a pin extends from the inner end of a ram for guidably fitting within a socket opening to the inner end of the other ram on one side of the blades, and another pin extends from the inner end of a ram for guidably fitting within a socket opening to the inner end of the other ram on the other side of the blades, as the ram bodies move out of the guideways, thus insuring alignment of the blades and thus their faces as they move into positions in which the outer ends of their shearing edges begin to overlap. As shown, both pins extend from the inner end of both sides of the same ram body and both sockets open from the inner side of both sides of the same ram body.

More particularly, a means is provided on each ram to form a pocket to closely receive the blade of the other ram, following fitting of the pins into the sockets, and prior to sealing engagement of the packing means upon continuing movement thereof to their inner positions, thus restraining the blade faces from separation as they continue to move to sealing position. As shown, the pocket of the first ram is formed by the lower face of the upper blade and bottom and inner side surfaces of the body of the first ram, and the pocket of the second ram is formed by the upper face of the lower blade and top and inner side surfaces of the body of the second ram.

In the preferred and illustrated embodiment of the invention, packing means is carried by the ram bodies for sealing engagement with respect to one another and with respect to the guideways in which they slide so as to close off the well bore when the object has been sheared and the ram bodies have been moved further to their inner positions. More particularly, the packing means includes side packers carried on opposite sides of the blades to slide along the sides of the guideway of the preventer body with its inner end positioned to engage the inner ends of the side packers of the other ram as the rams move into their inner positions, and a top packer is carried in the top of each ram body to slide along the top of the guideway and engaging at each end with a side packer. Thus, the inner sides of the side packers of each ram are adjacent the sides of the blade carried by the ram body and thus in position to form a part of the pocket which closely receives the sides of the blade carried by the other ram body.

The packing means also includes a top seal in a groove across the top of each ram body, and seal strip extending within a groove in the lower face of the upper blade to seal with the upper face of the bottom blade. The ends of both the top and cross seals engage with the inner sides of the packers on each side of the ram body, so that the packing will be energized when the ends of the solid packers are forced against one another.

As illustrated, both the pins and sockets extend from the inner ends of the side packers, and a rod on the outer end of each pin is mounted within a hole in the body of one ram, and a rod on the outer end of each socket is mounted within a hole in the body of the ram, so as to retain side packers on the ram bodies. The outer end of each rod extending into a hole in the ram body and has freedom of outward movement therein as the front ends of the side packers are compressed against one another. Thus, each top packer has a pair of pins each for extending through a hole in the ram body, and each said pin extends within slot in the side of the outer end of the pin or socket. Also, each side packer includes a body of rubber having a metal plate on its inner side which extends from the upper or lower edge of the body to above the upper or lower surface of the blade to form part of the pocket.

The cross seal strip is within a groove in the lower face of the upper blade face which has sides tapered toward the face, with the sections of the groove and strip extending generally parallel to the shear edge of the lower blade and positioned so that the upper face of the lower blade passes over it at the end of its inward movement but before the end faces of the side packers engage. In accordance with another novel aspect of the invention, however, the strip includes a body of rubber fitting closely within the groove and having a lower side recessed from the lower blade face, and a metal strip adjacent its rear side and protruding from the lower face of the upper blade so as to extrude the rubber against the face of the lower blade as the shear edge of the other blade moves over it.

In the drawings, wherein like reference characters are used throughout to designate like parts:

FIG. 1 is a side view, partly in section and partly in elevation, of a blowout preventer constructed in accordance with this present invention, with the rams withdrawn to their outer positions and showing an object such as tubing in broken lines extending through the bore of the preventer housing;

Figure 4:
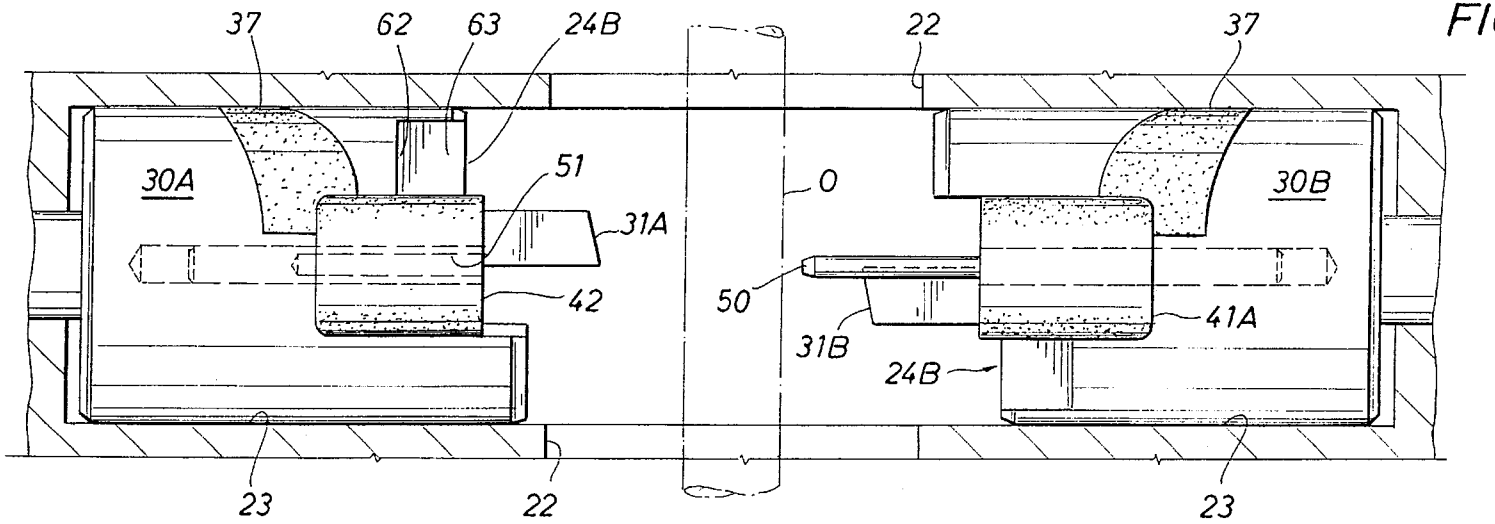
FIG. 4 is a vertical sectional view through the preventer body, showing the rams in side elevation and disposed in the inner positions of FIG. 1.
Figure 5:
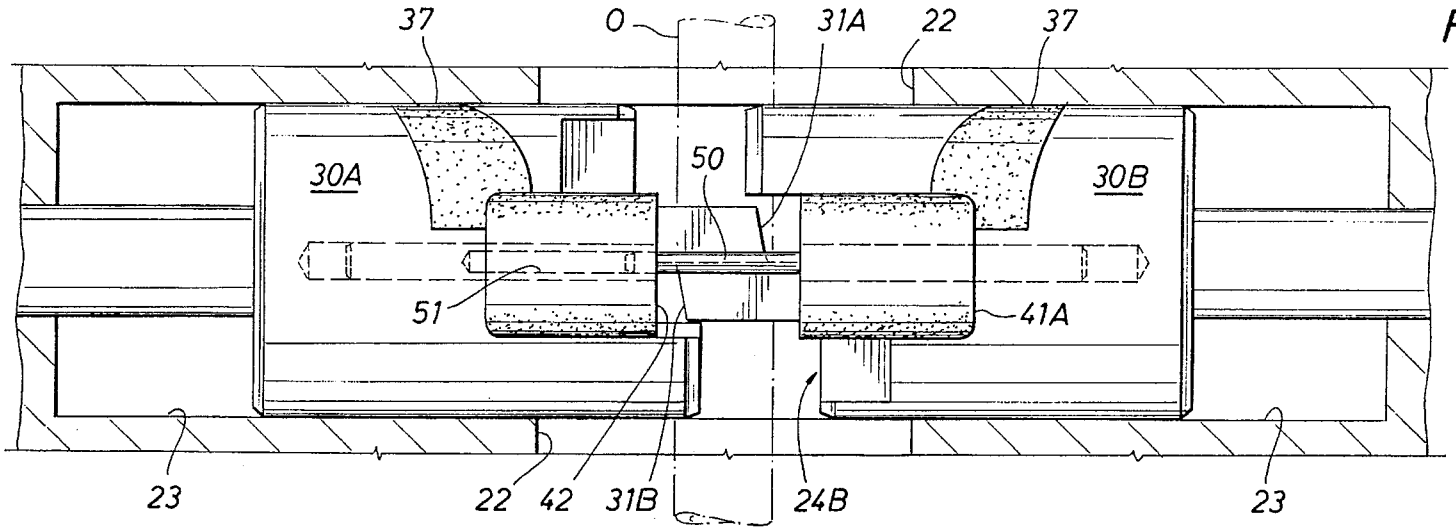
FIG. 5 is a cross-sectional view of the preventer body and side elevational view of the rams, similar to FIG. 4, but with the rams moved inwardly from their outer positions to a point at which the pins on the right-hand ram begin to enter the sockets in the left-hand ram.
Figure 6A:
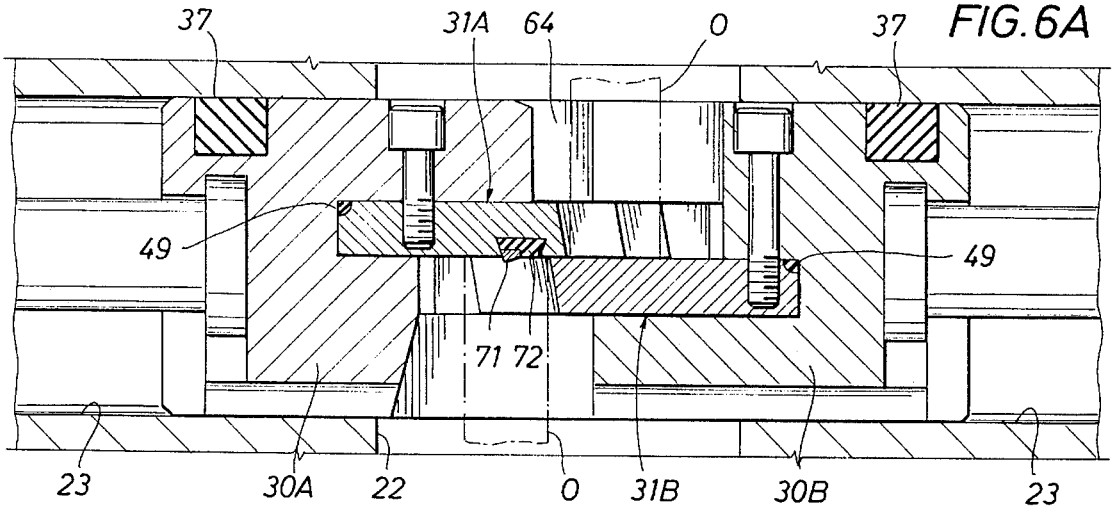
FIG. 6A is a view similar to FIGS. 4A and 5A, but with the rams in the position of FIG. 6.
Figure 7A:
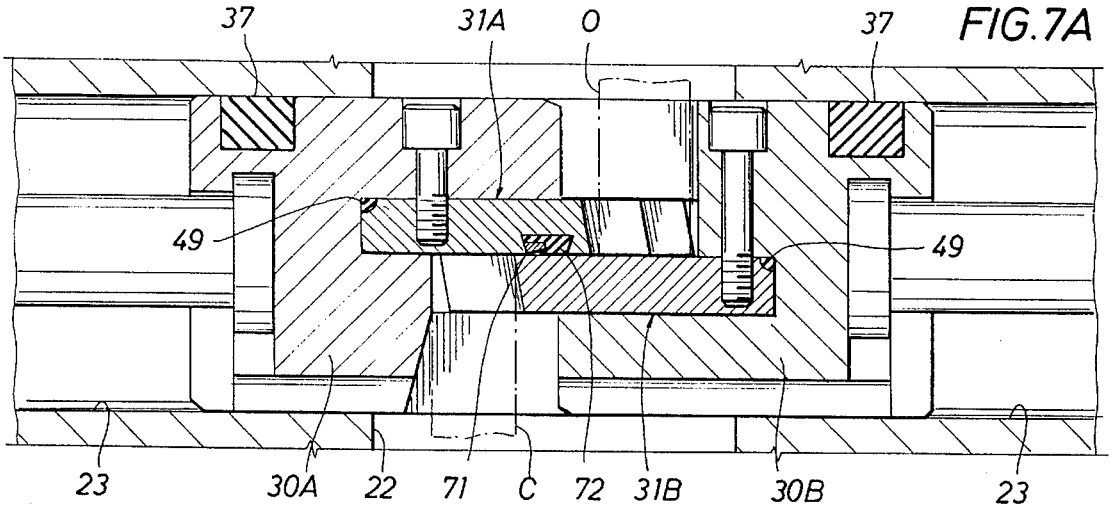
Figure 6:
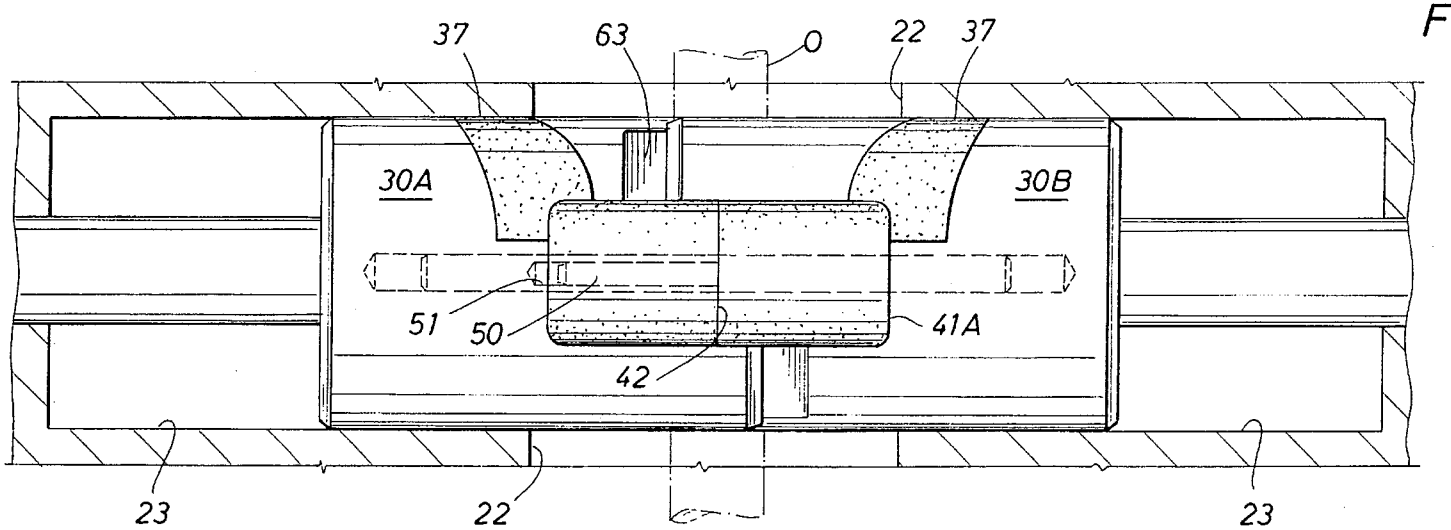
FIG. 6 is a vertical sectional view of the preventer housing and a side elevational view of the rams, similar to FIGS. 4 and 5, but with the rams moved further inwardly to move the pins fully into the socket cause the inner faces of the side packers to engage one another as the shear edges shear the object in the bore.
Figure 7:
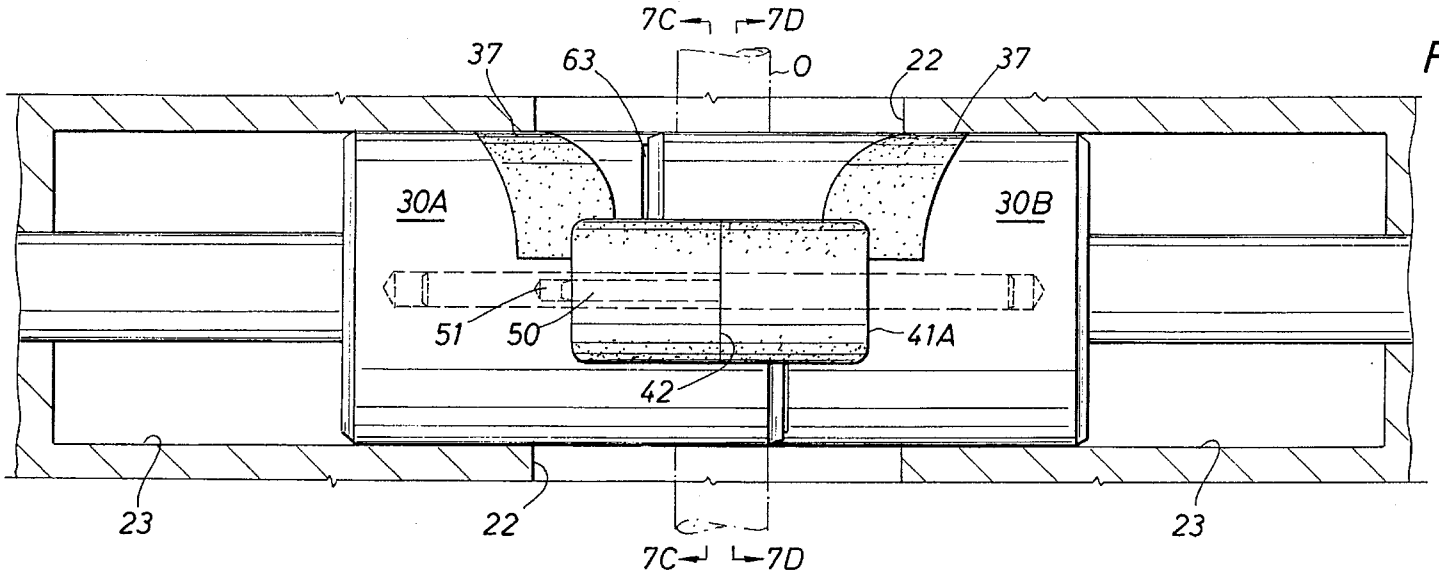

FIG. 7 is a cross-sectional view of the preventer housing and a side elevational view of the rams similar to FIGS. 4, 5 and 6, but with the rams moved further to compress the ends of the side packers and thus energize the side packers to seal with respect to one another and the guideways as well as the top packings to seal with respect to the guideway and the cross packing to seal between the rams and with respect to the side packers at its ends.

Figure 2:
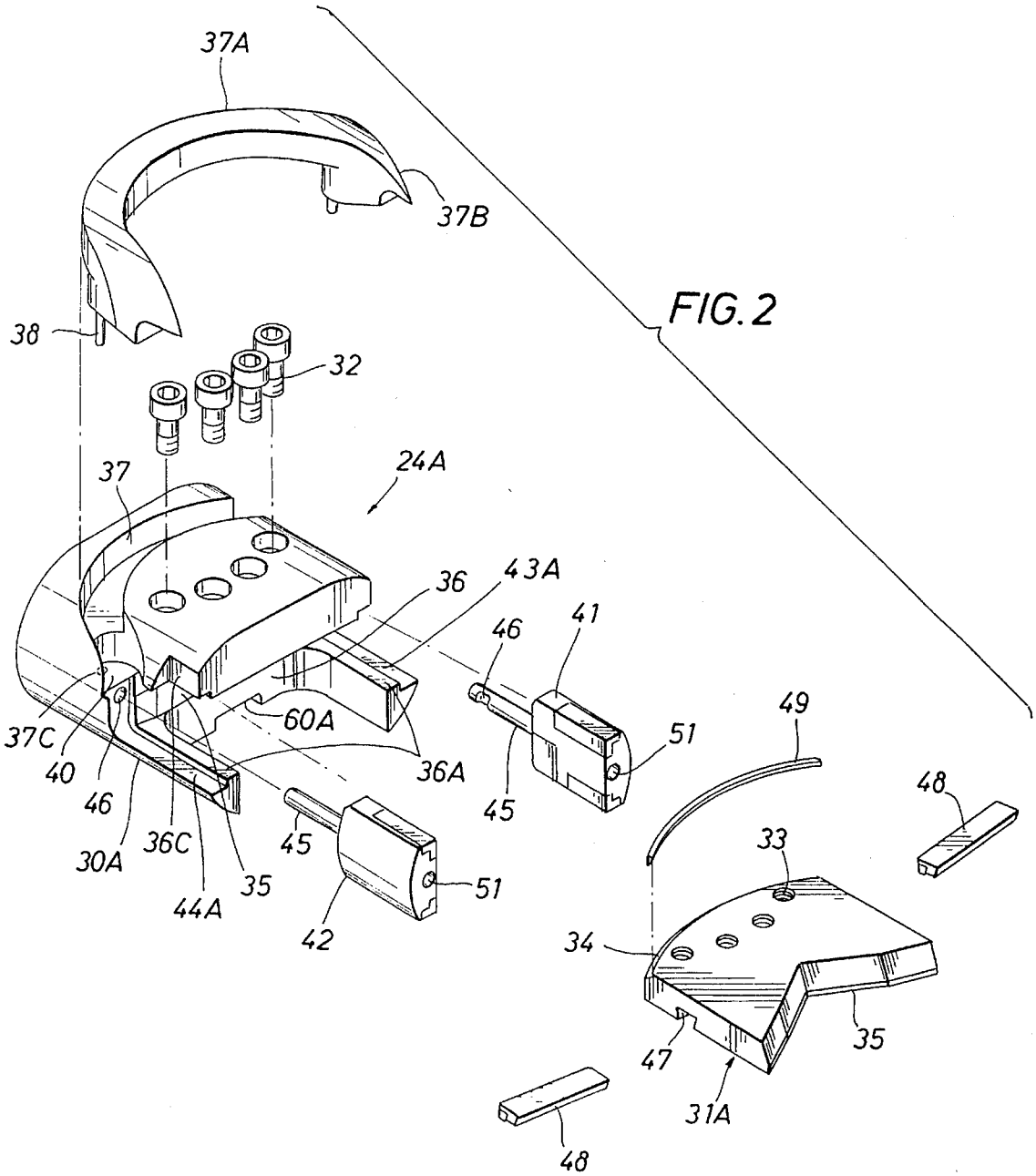
FIG. 2 is an enlarged exploded view of the parts of the left-hand ram of the preventer shown in FIG. 1.
Figure 4A:
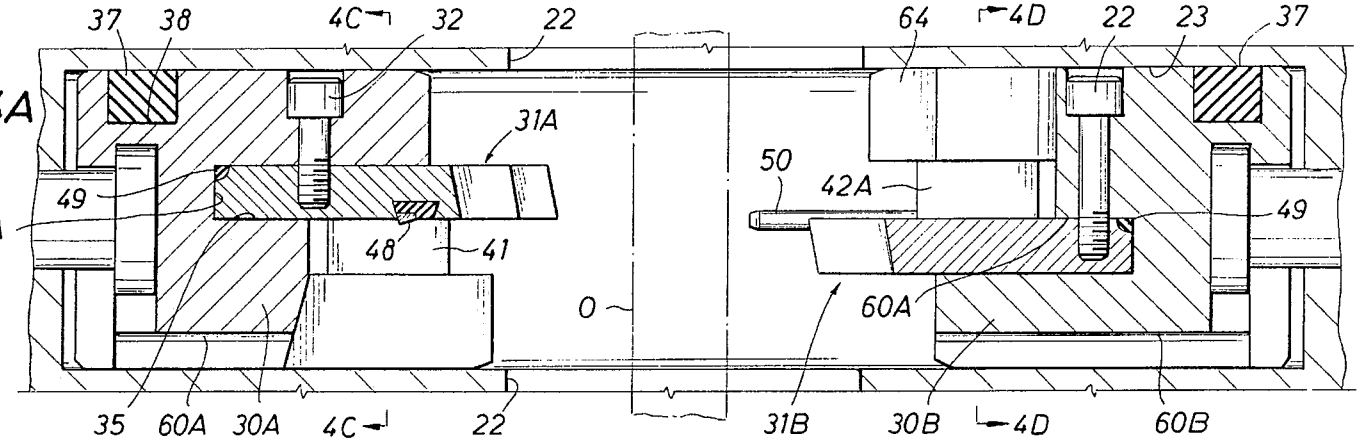
FIG. 4A is a vertical sectional view, as seen along broken lines 4A—4A of FIG. 4B.
Figure 4B:
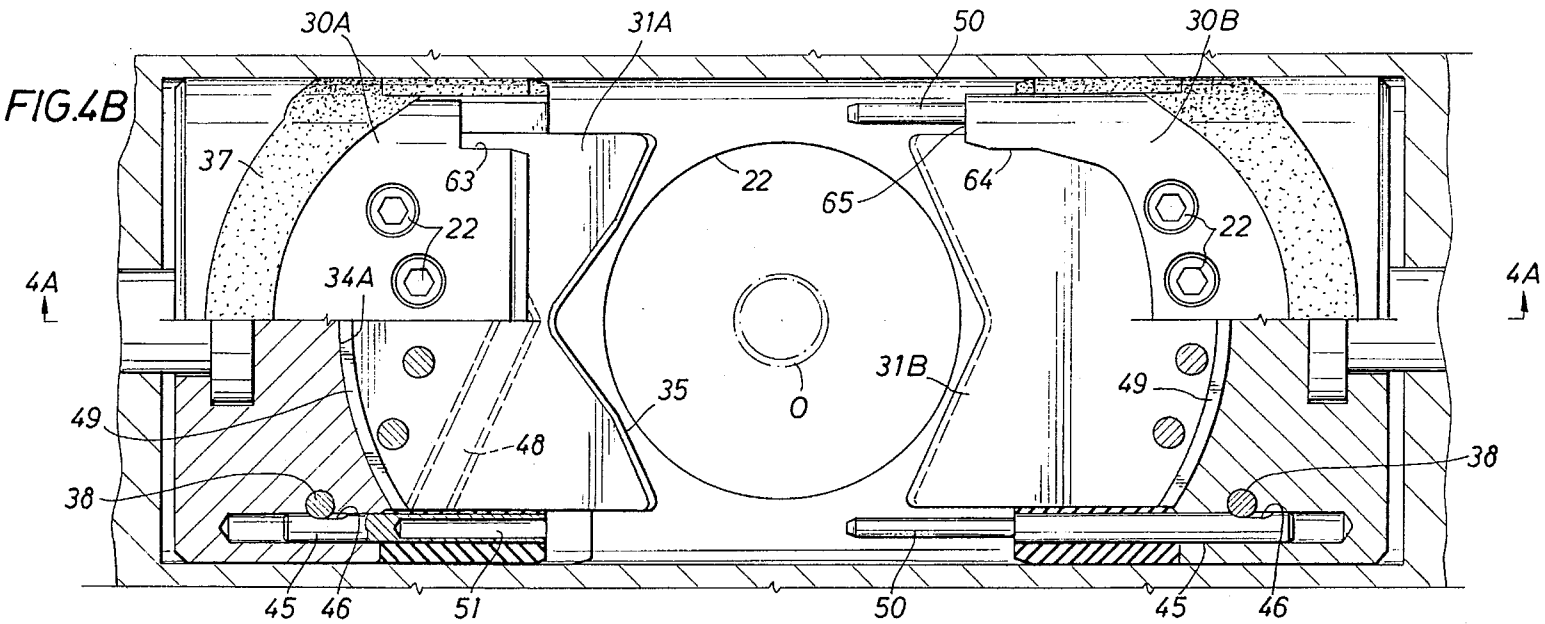
FIG. 4B is a horizontal-sectional view of the preventer, body and showing both the left-hand and right-hand rams partly in plan and partly in horizontal section.
Figure 5A:
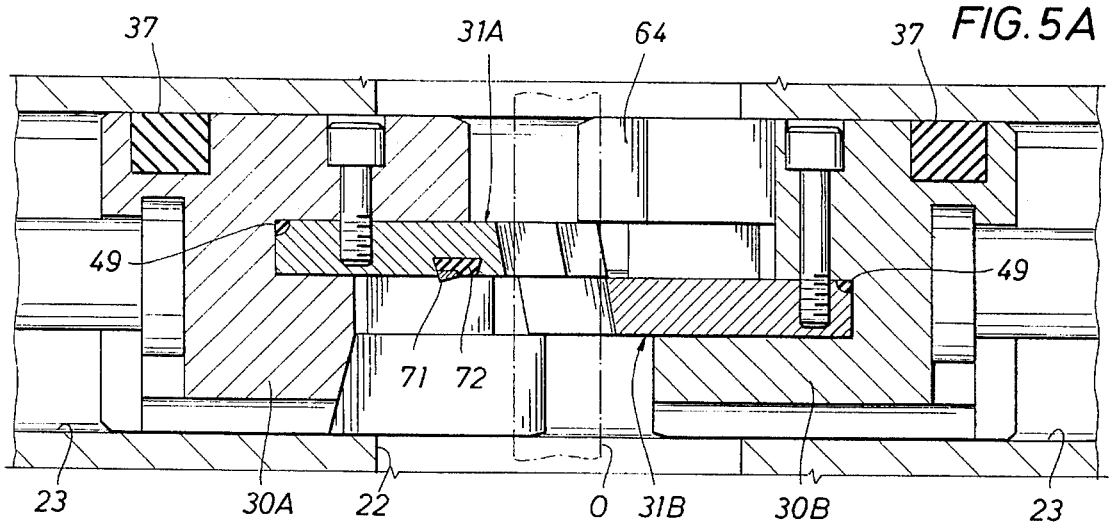
FIG. 5A is a view similar FIG. 4A, but showing the rams in the position of FIG. 5.
Figure 7C:
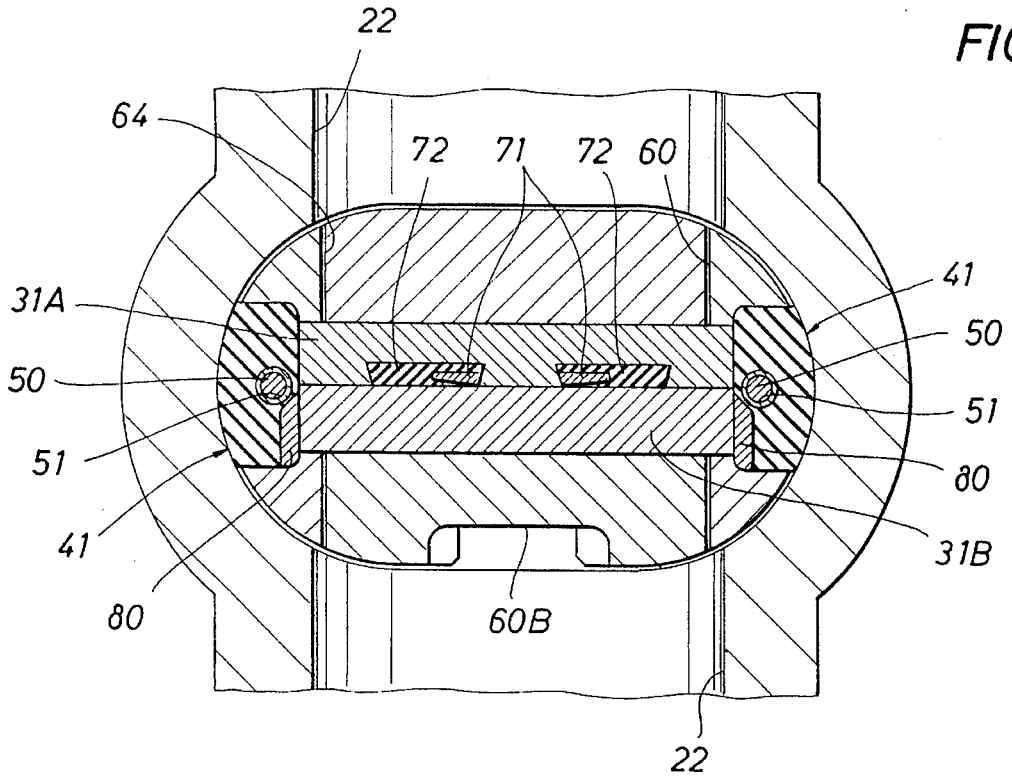
Figure 7D:
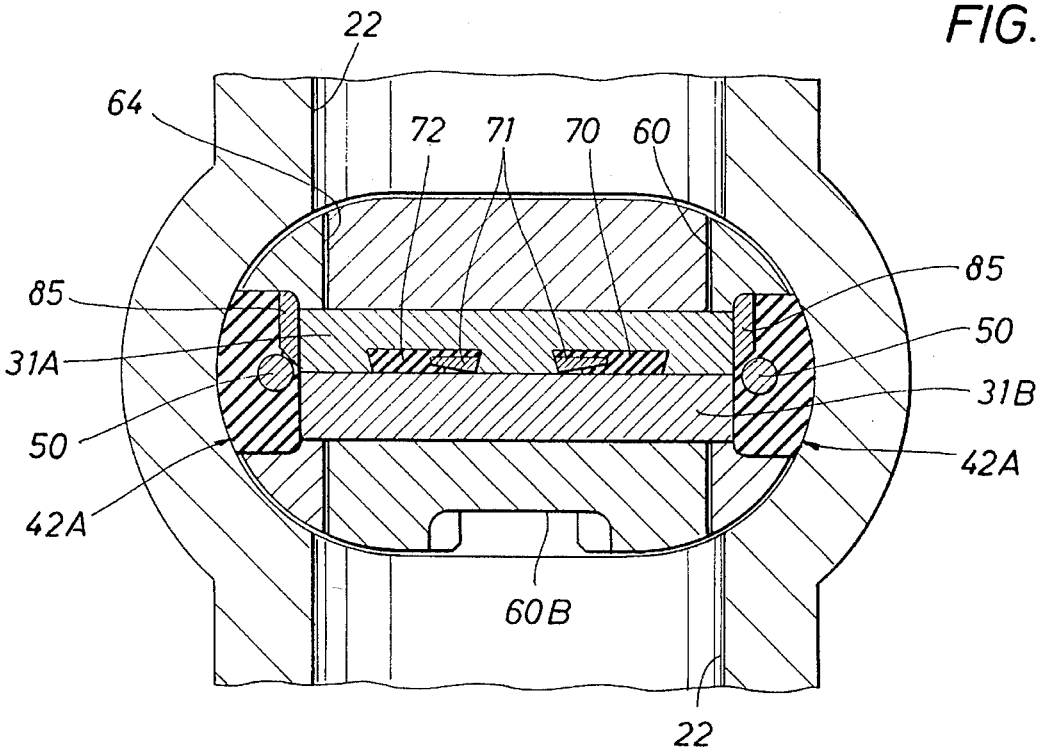
Figure 5B:
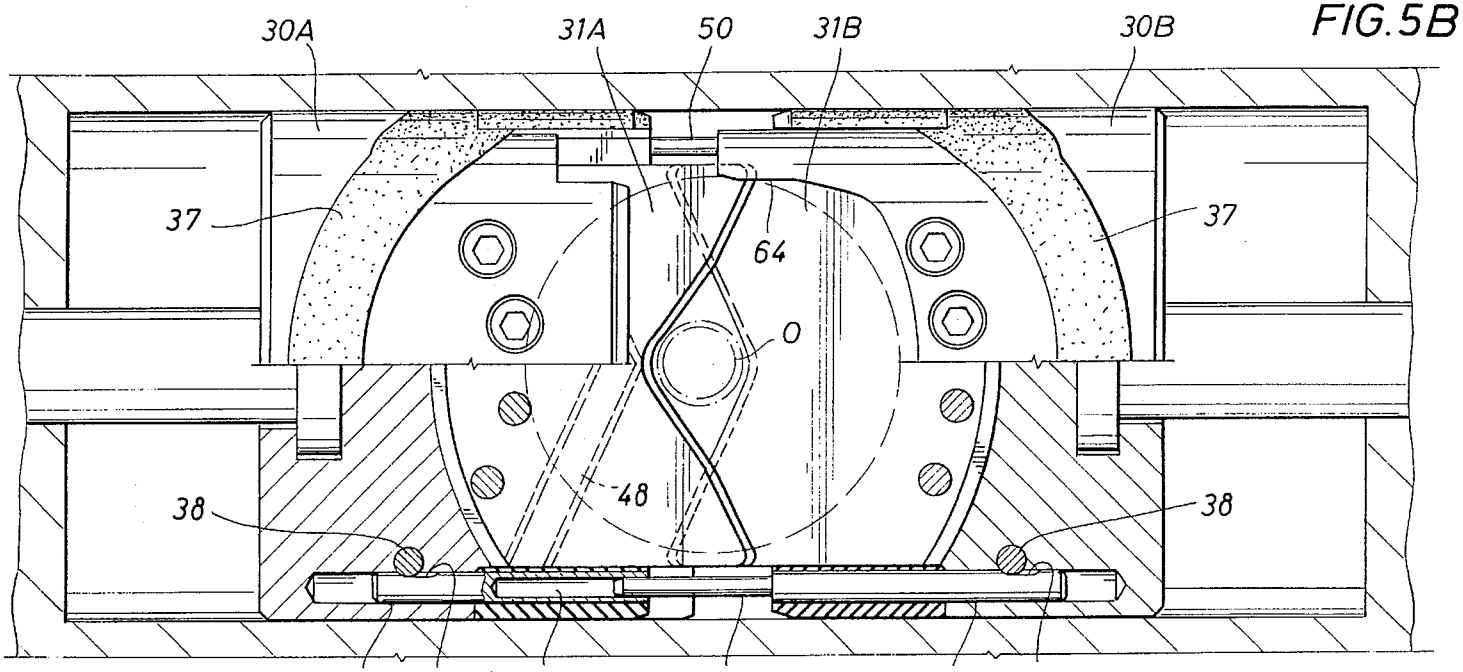
FIG. 5B is a view similar to FIG. 4B, but showing the rams in the position of FIG. 5.
Figure 8B:
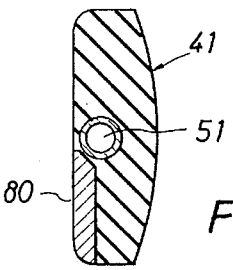
Figure 8A:
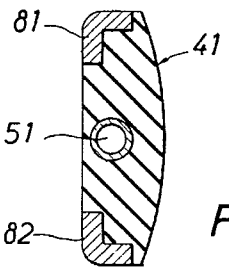
Figure 8:
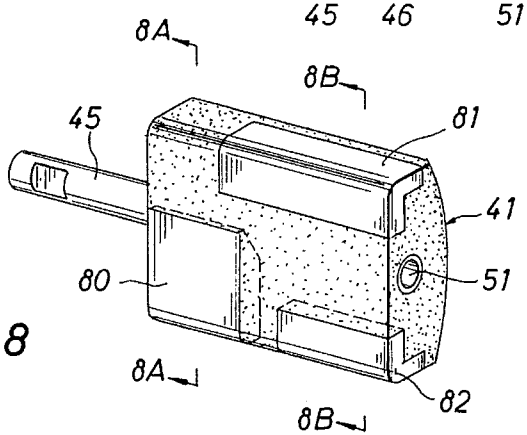
Figure 6B:
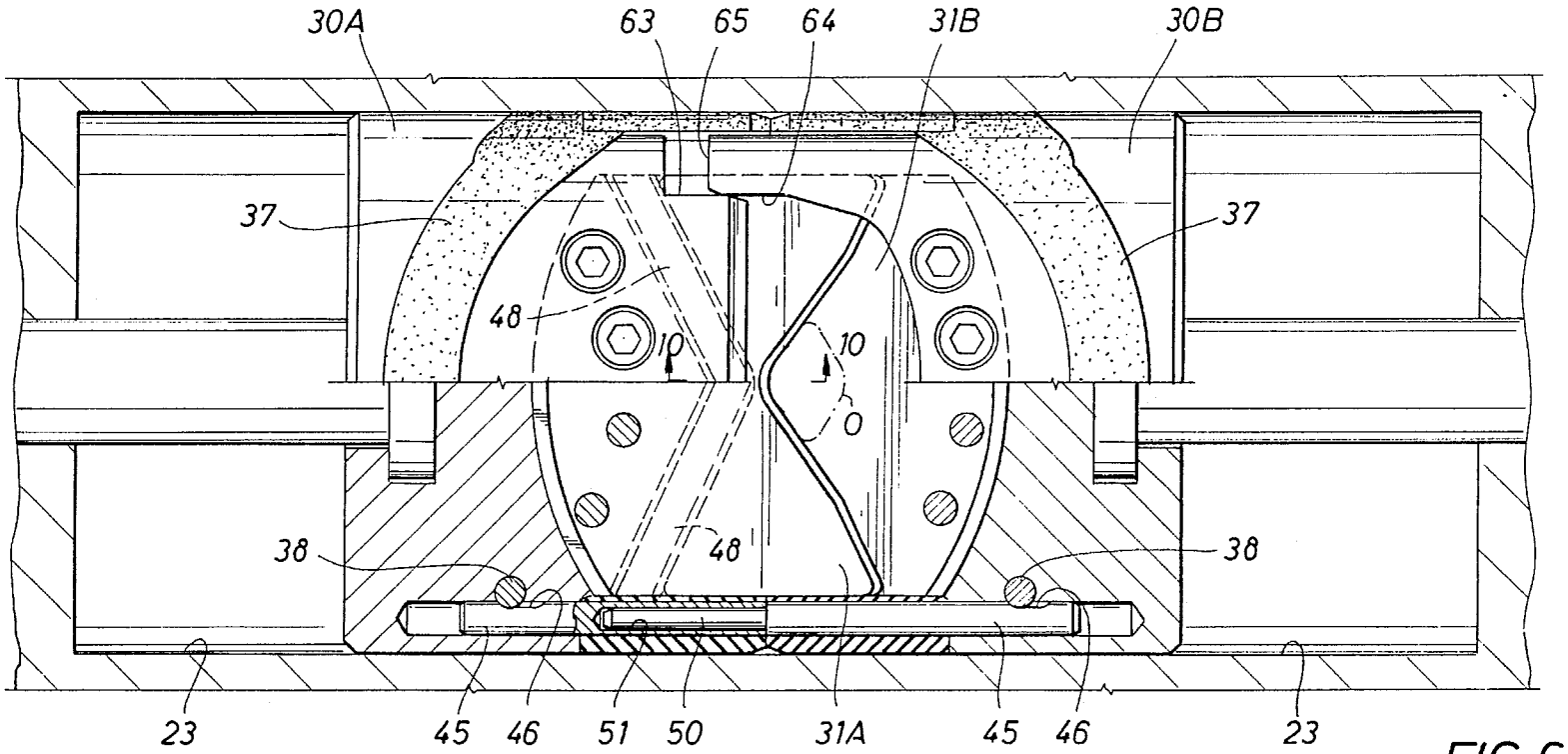
FIG. 6B is a view similar to FIGS. 4B and 5B, but with the rams in the position of FIG. 6.
Figure 10:
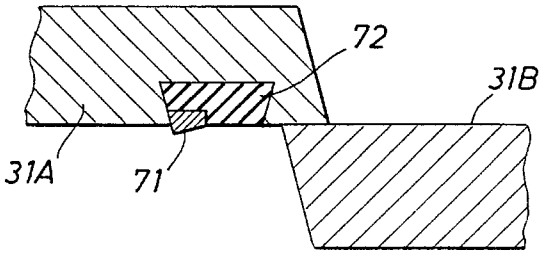
Figure 7B:
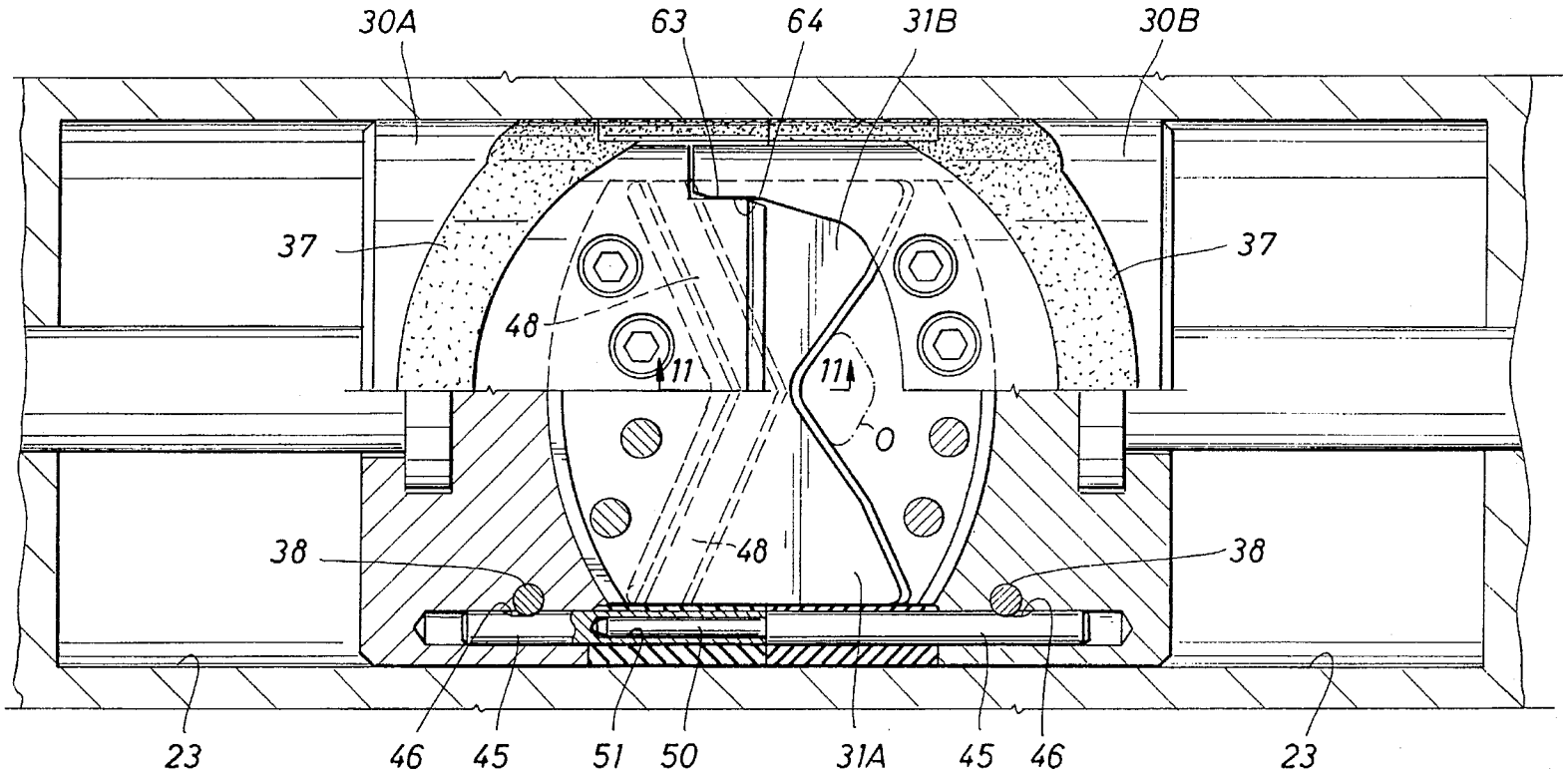
Figure 11:
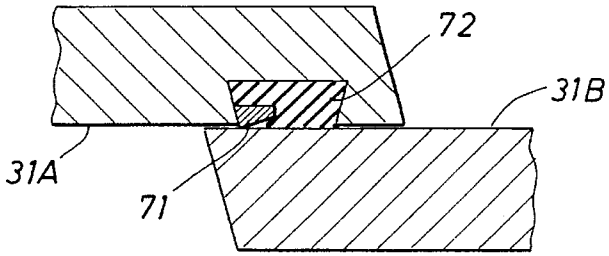
Figure 2:
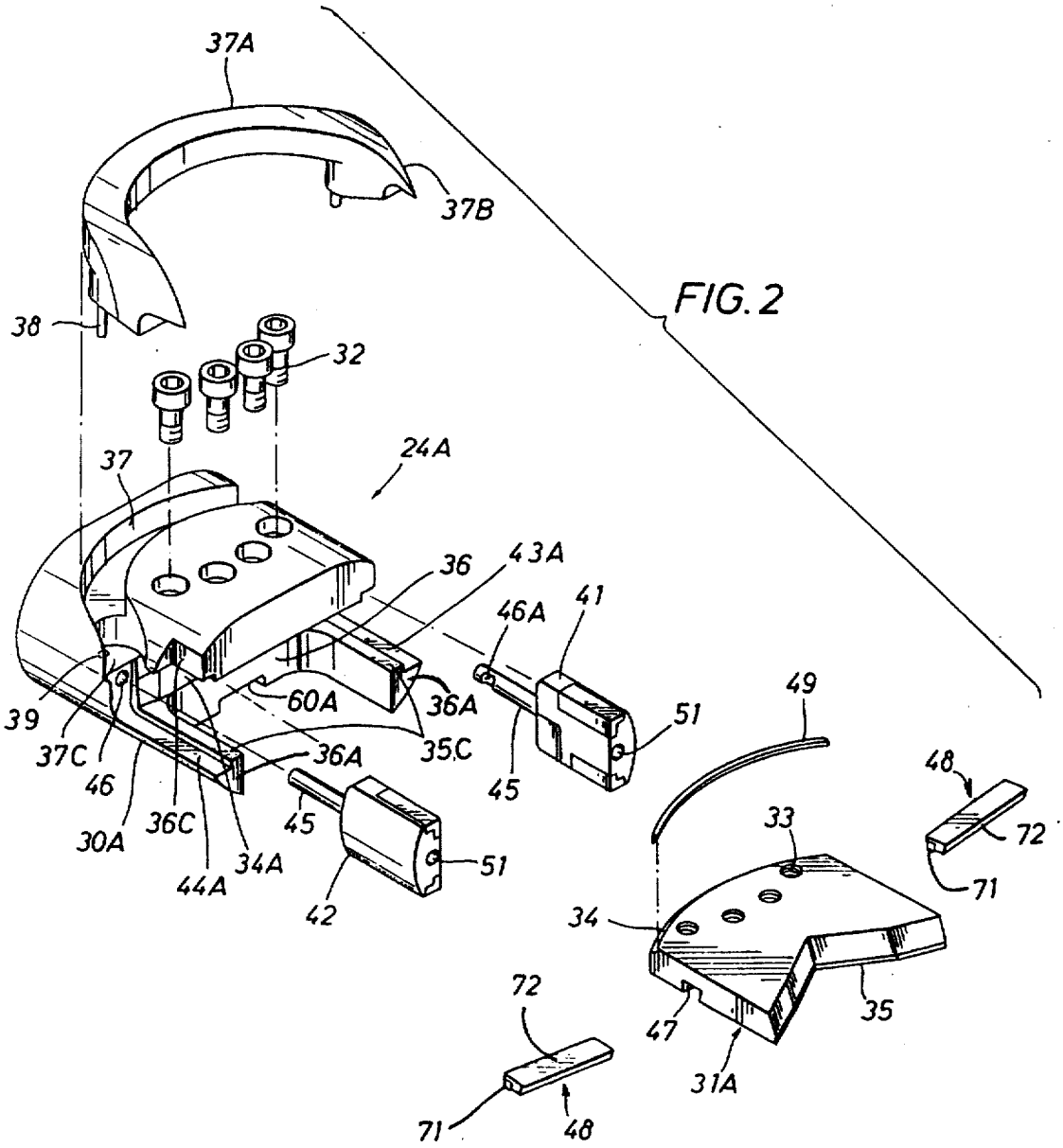
Figure 3:
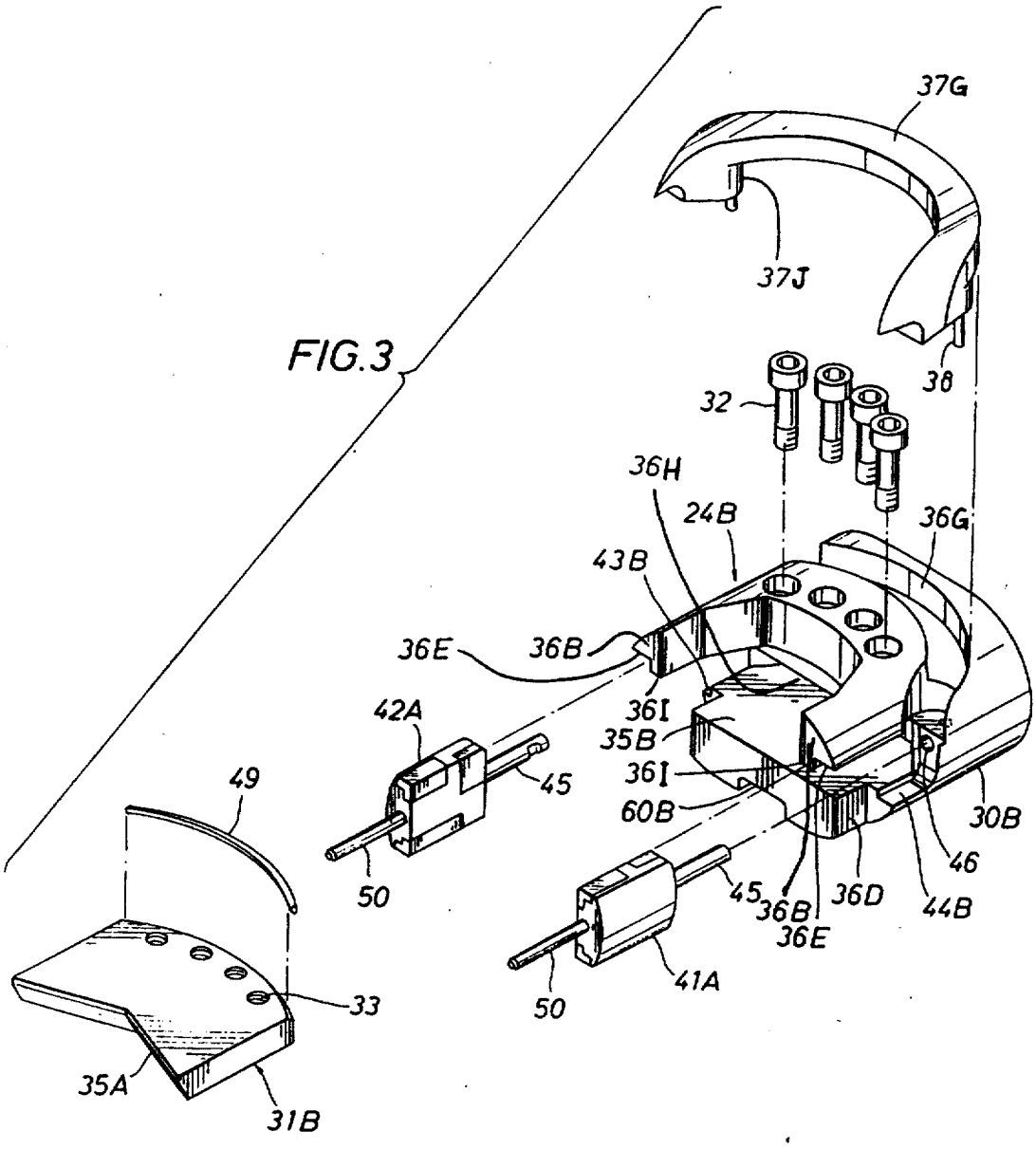
Figure 4:
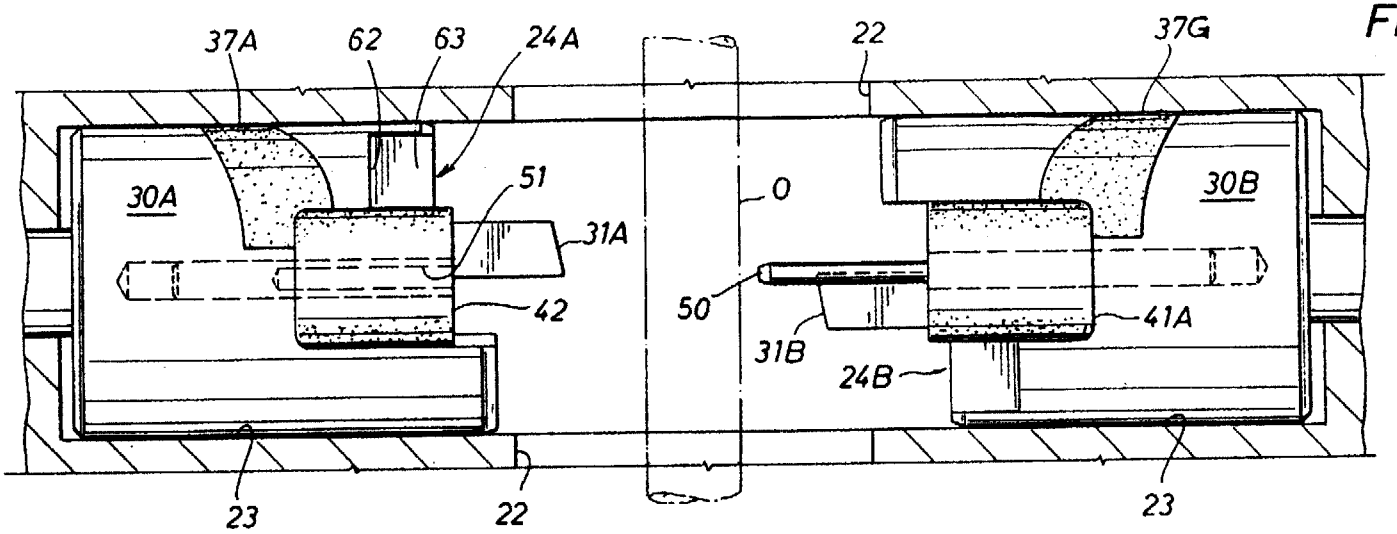
Figure 5:
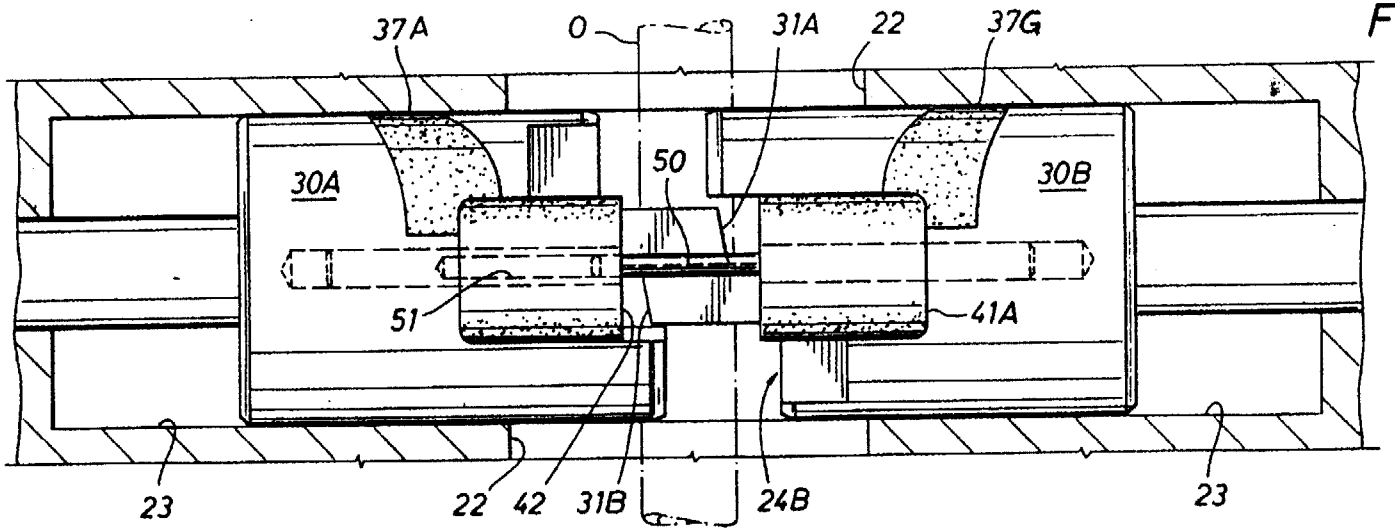
Figure 4A:
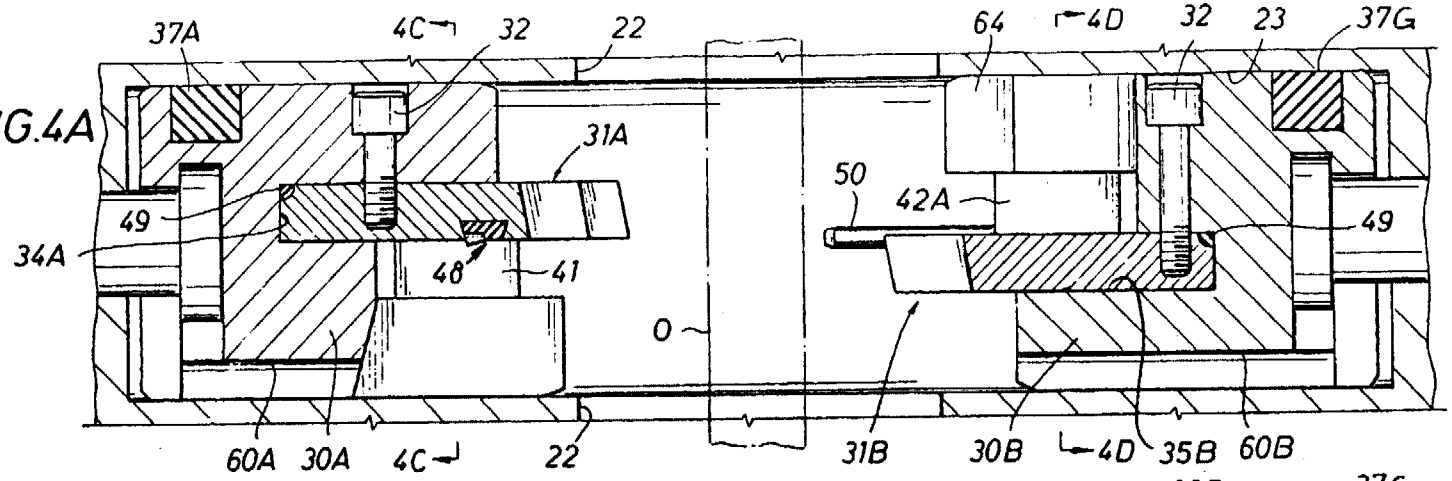
Figure 4B:
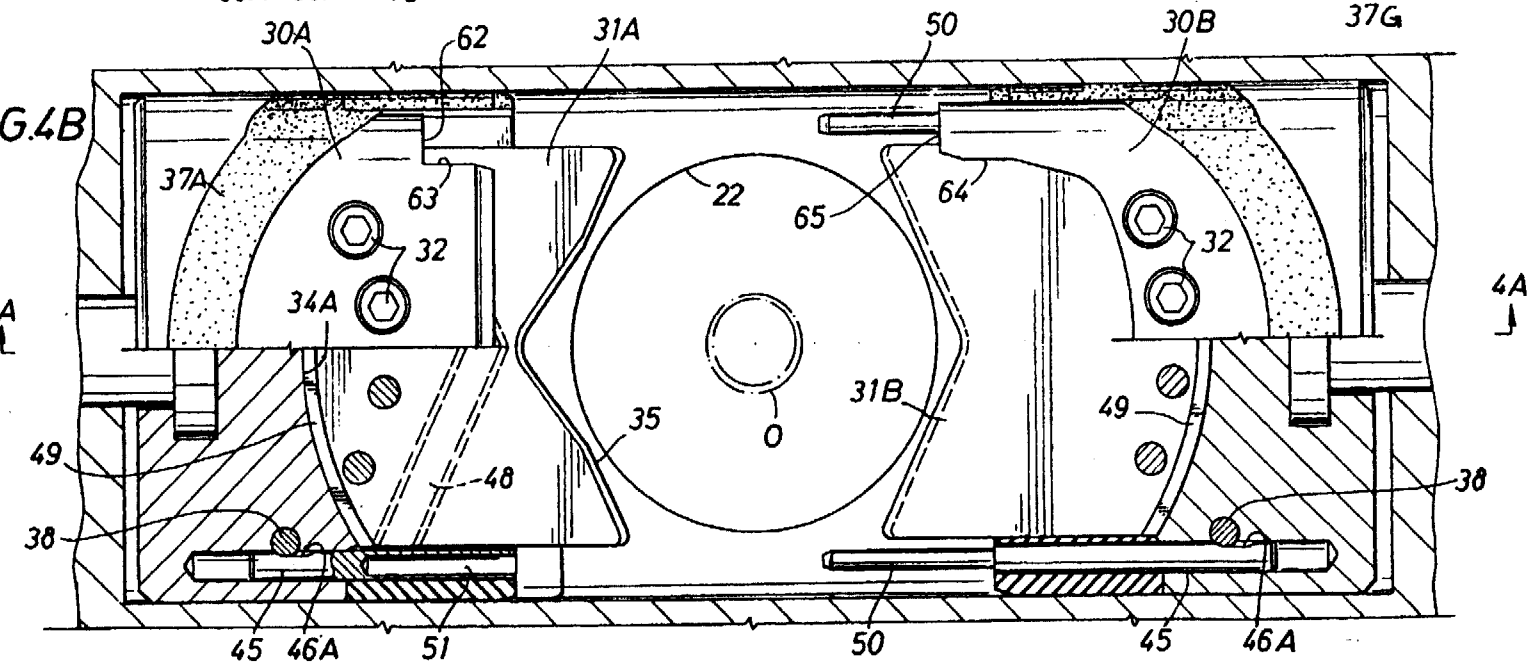
Figure 4C:
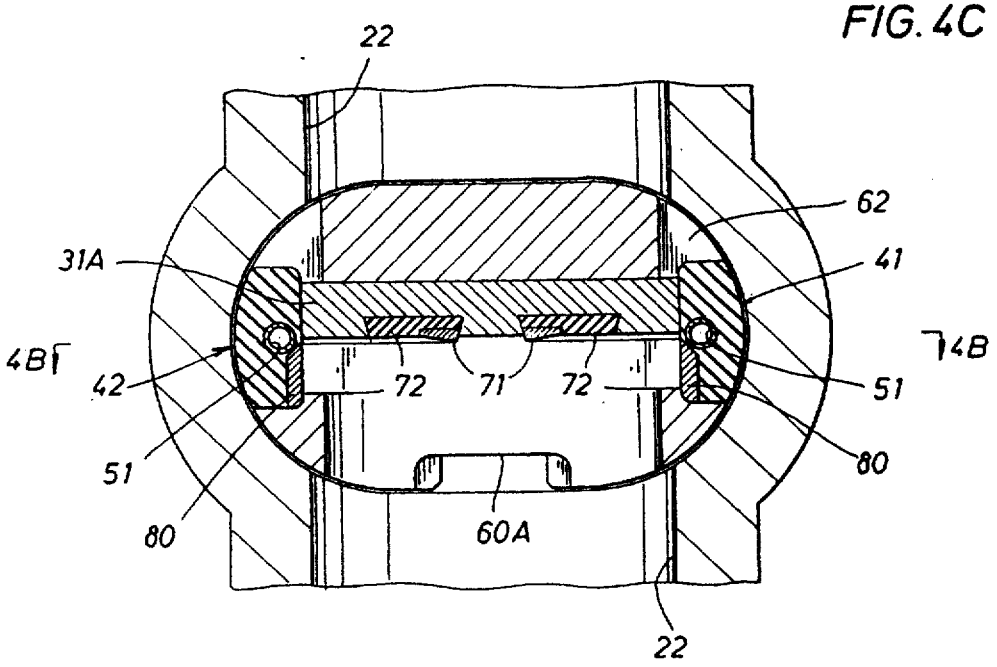
Figure 4D:
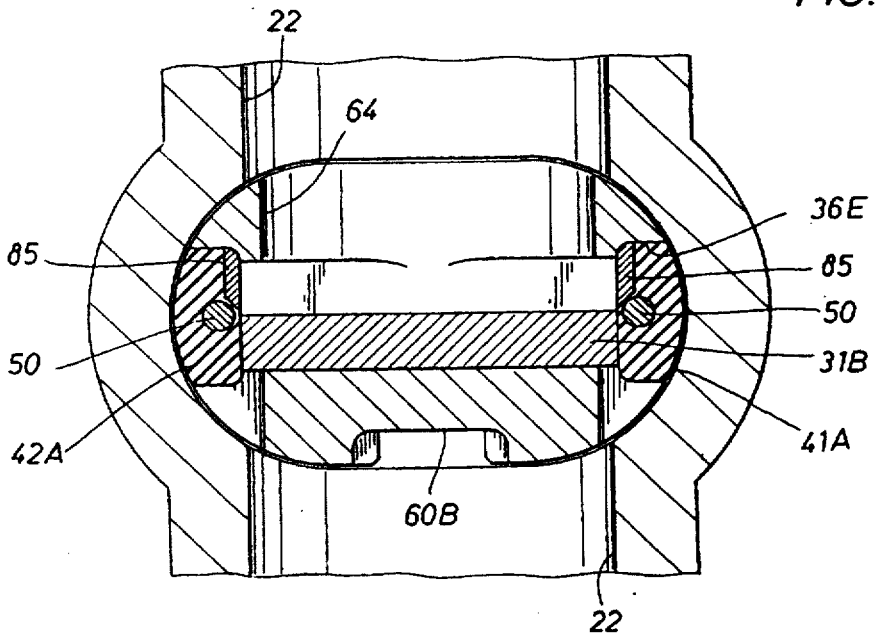
Figure 5A:
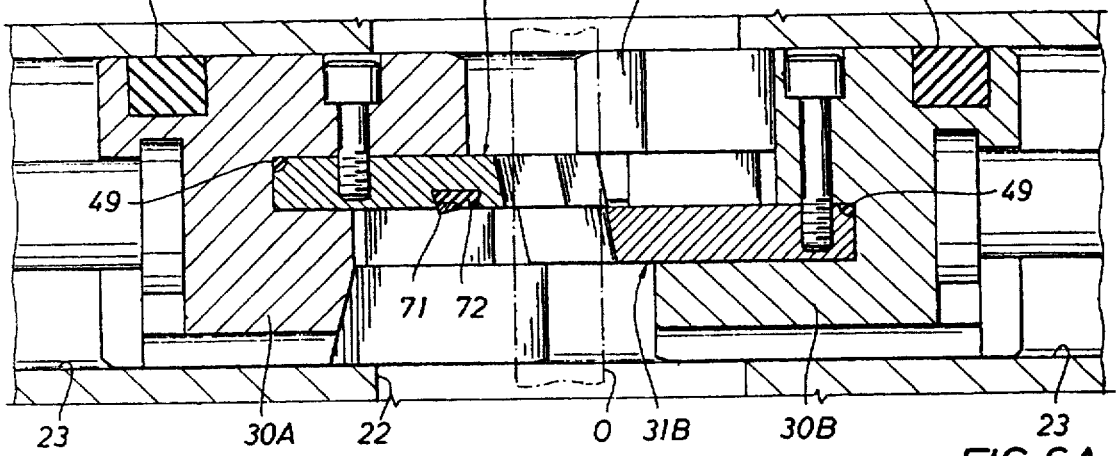
Figure 6A:
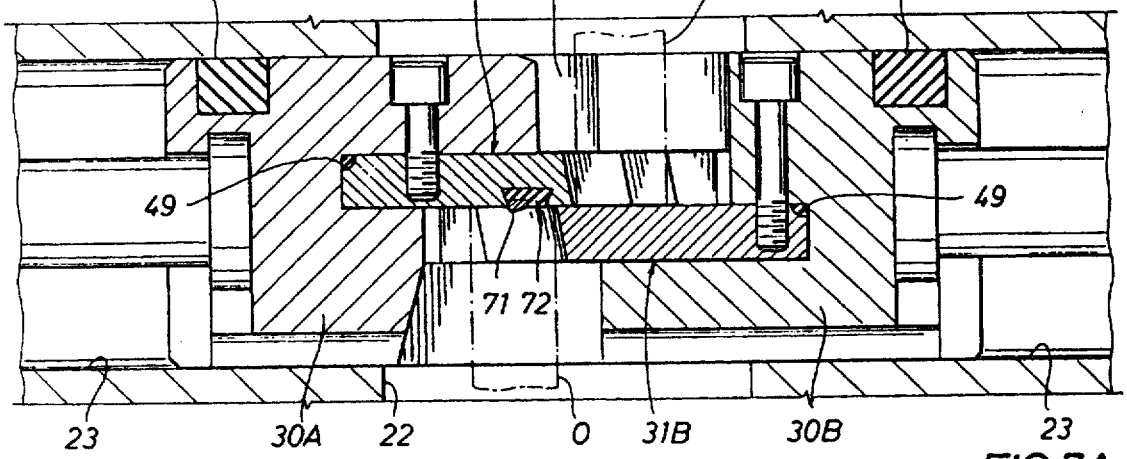
Figure 7A:
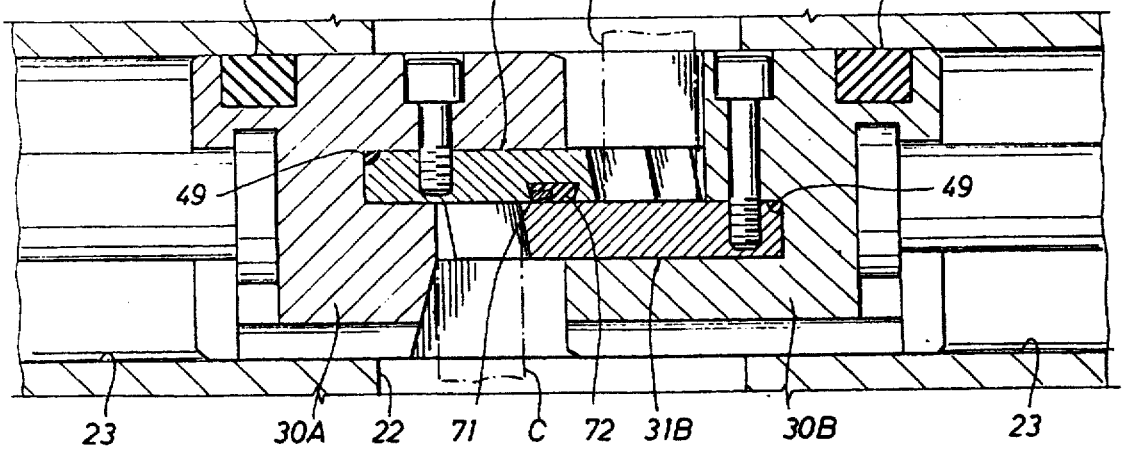
Figure 5B:
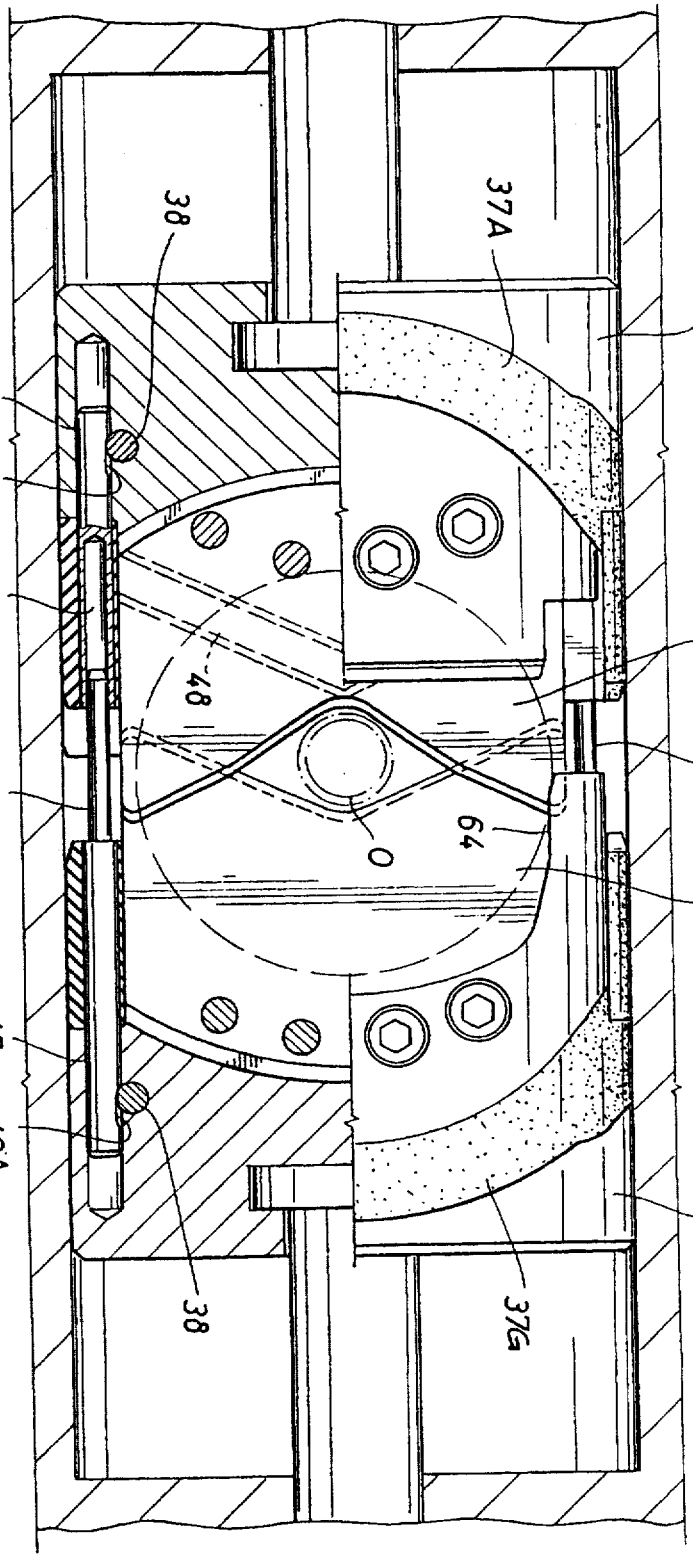
Figure 8:
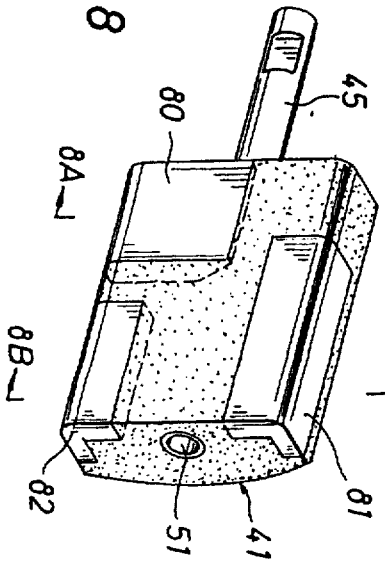
Figure 8A:
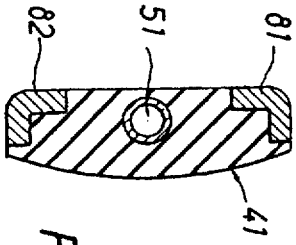
Figure 8B:
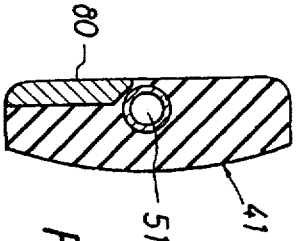
Figure 7:
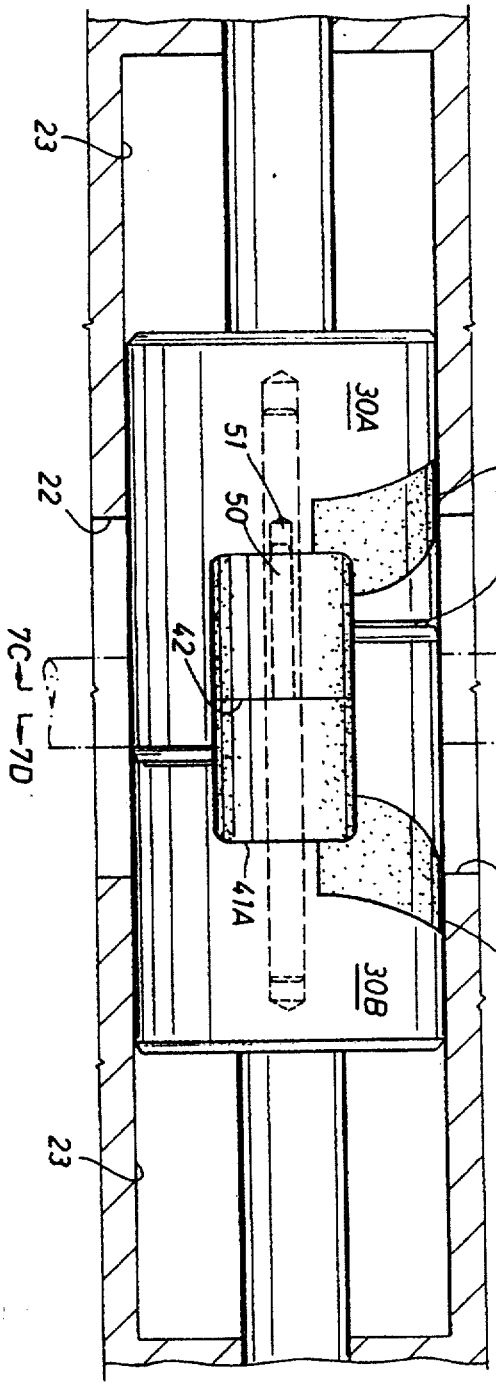
Figure 6:
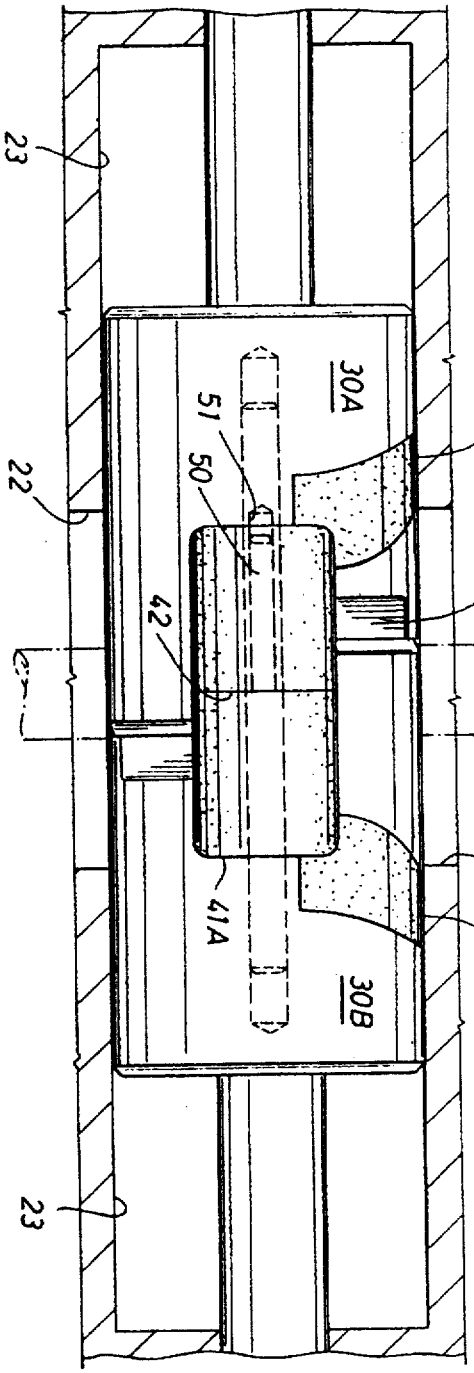
Figure 7C:
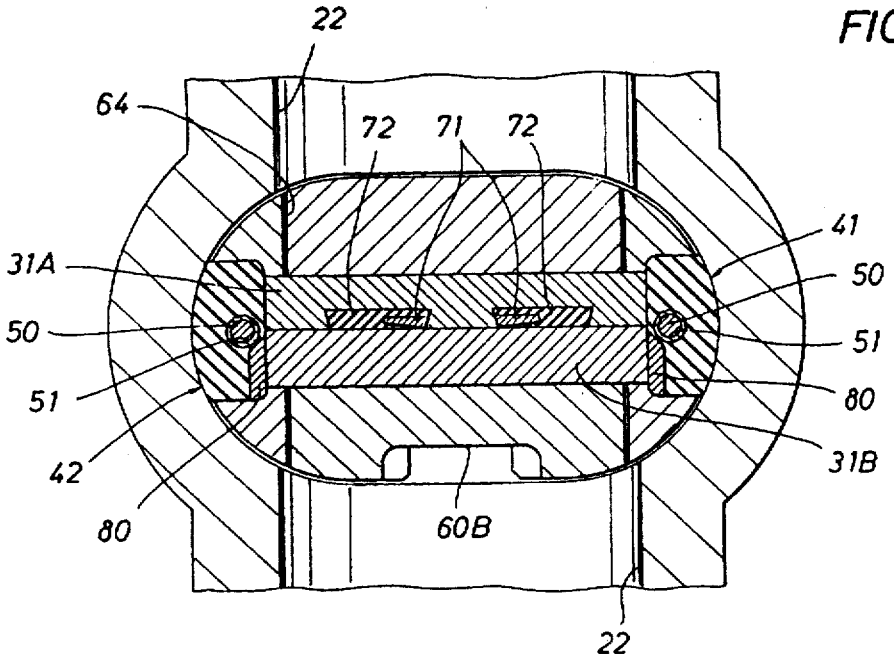
Figure 7D:
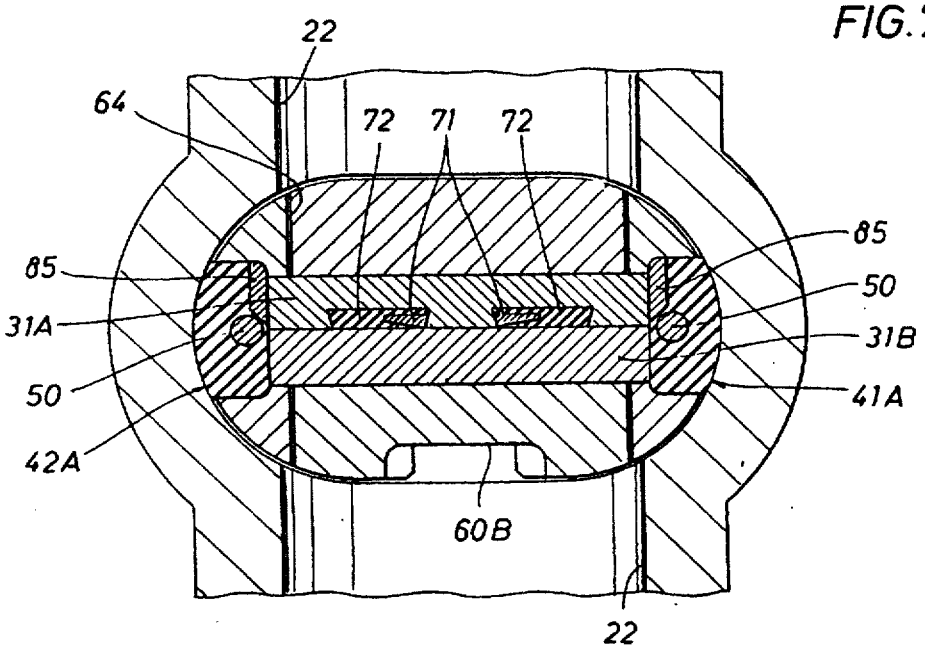
Figure 10:
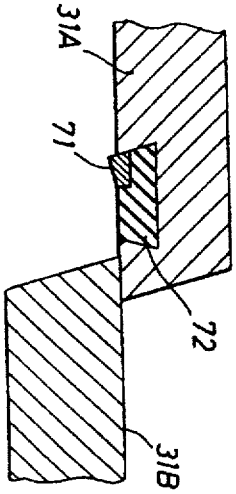
Figure 6B:
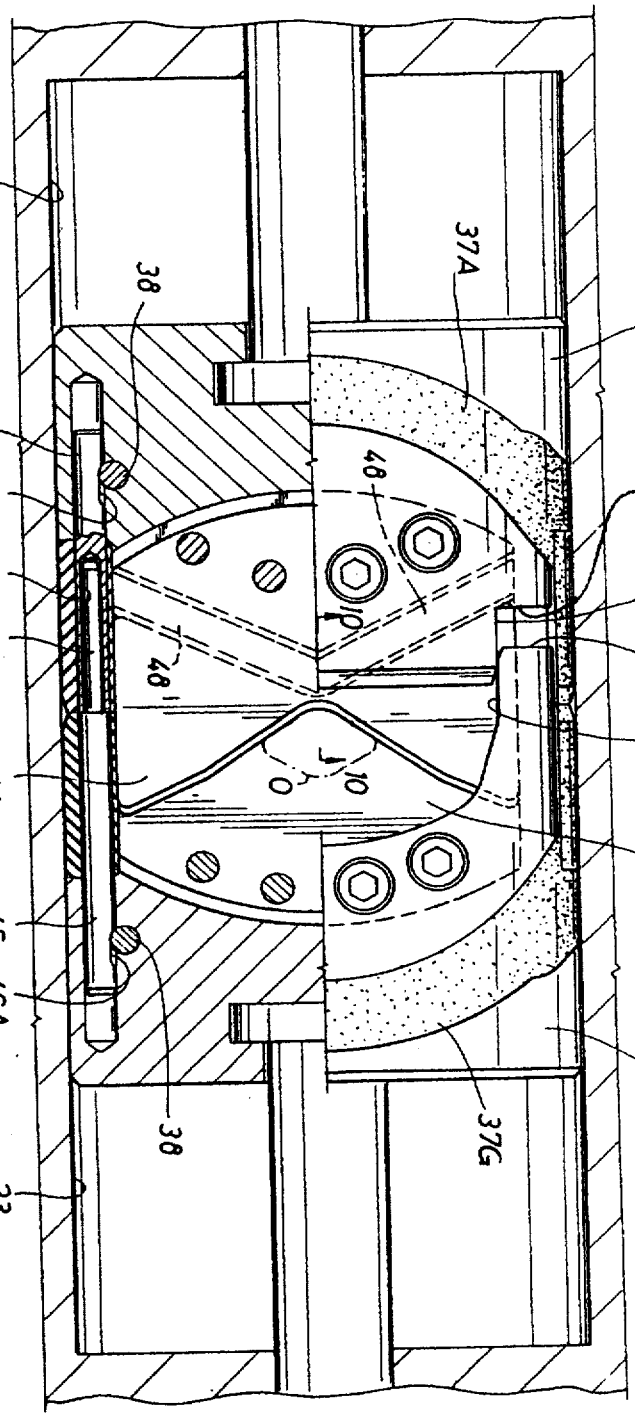
Figure 11:
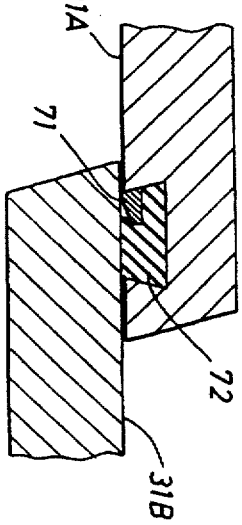
Figure 7B:
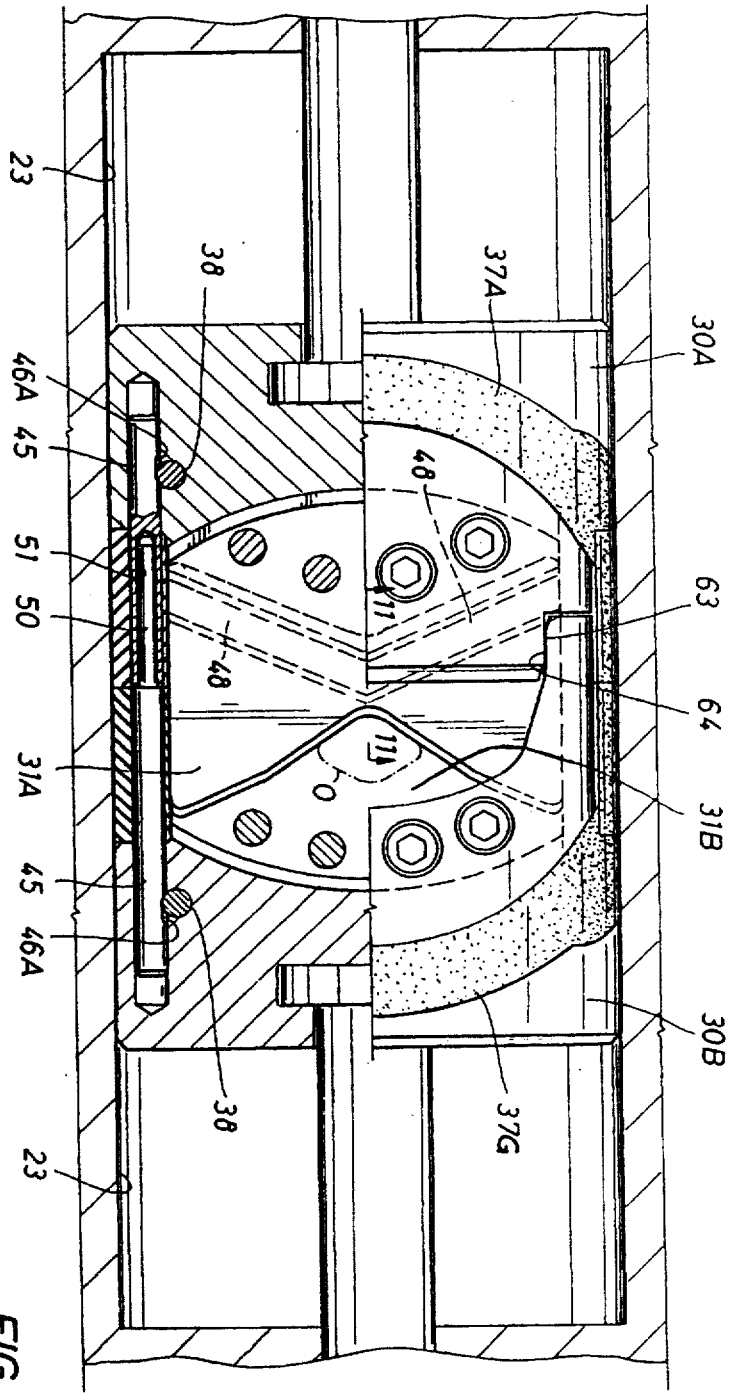

FIG. 7A is a view similar to FIGS. 4A, 5A and 6A, but with the rams in the position of FIG. 7;

FIG. 7B is a view similar to FIGS. 4B, 5B and 6B, but with the rams in the position of FIG. 7;

FIG. 7C is a cross-sectional view of the rams, as seen along broken lines FIG. 7C—7C of FIG. 7;

FIG. 7D a cross-sectional view of the rams, as seen along broken lines 7D—7D of FIG. 7;

FIG. 8 is a perspective view on an enlarged scale of the left-hand side packer of the left-hand ram shown in FIG. 2;

FIGS. 8A and 8B are cross-sectional views of the side packer of FIG. 8, as seen along broken lines 8A—8A and 8B—8B, respectively, thereof;

FIG. 9 is a perspective view on an enlarged scale of the right-hand side packer of the right-hand ram;

FIGS. 9A and 9B are cross-sectional views of the right-hand side packer as seen along broken lines 9A—9A and 9B—9B of FIG. 9;

FIG. 10 is an enlarged cross-sectional view of the inner ends of the blades of the rams as they begin to overlap and;

FIG. 11 is an enlarged cross-sectional view of the inner ends of the blades of the rams, similar to FIG. 10, but upon further inward movement, and as seen along broken lines 11—11 of FIG. 7B, to show the metal insert forced upwardly to exclude the cross seal strip packing carried by the upper blade face against the lower blade face.

With reference now to the details of the above-described drawings, the blowout preventer shown in FIG. 1 and designated in its entirety by reference character 20, includes a housing 21 having a vertical bore 22 therethrough and flanges at its upper and lower ends to permit it to be installed in alignment with the bore through a wellhead above a well bore. As previously described, the preventer is normally used during drilling and/or completion of a well, although, as previously described, it may also be used during remedial operations on a completed well.

The housing also has guideways 23 extending from opposite sides of the bore each of which is adapted to receive a ram for sliding therein between the outer position shown in FIG. 1, wherein the rams are removed from the bore through the housing, and an inner position in which the rams are engaged with one another to seal between them as well as with respect to the guideway in which they are received, thus closing off the bore through preventer. The left-hand ram is indicated in its entirety by reference character 24A and the right-hand ram in its entirety by reference character 24B.

As the rams move toward their inner positions, they shear or cut an object 0 extending within the wellbore, which, as previously described, may be tubing as shown in broken lines, or one of many other different types. This permits the sheared upper portion of the object to be removed from the wellhead, and, if desired, upon opening of the rams, a well pipe to be lowered into the bore for sealably engaging over the upper end of the lower sheared portion of the tubing.

As best shown in other drawings of the application, the rams are generally oval in cross section for fitting closely within similarly shaped guideways, and, as shown in FIG. 1, the outer open ends of the guideways are adapted to be closed by an operator 25 bolted or otherwise secured to the preventer housing. The operator may include a rod 26 which is removably connected to the outer end of the ram and has a piston 27 slidable within a cylinder 28 of the operator for moving the rams between their inner and outer positions, all in a manner well known in the art.

As will be further described in the description to follow, and in accordance with well-known techniques in this art, the sealing engagement of the rams with one another is enhanced by well pressure beneath the closed rams, which has access to the outer ends of the rams to provide an inwardly directed force urging them against one another. Also, the operator conventionally has means by which the rams may be withdrawn from the outer open ends of the guideways to permit them to be replaced and/or removed from the operator by lifting from the inner ends of the piston rods. Obviously, other types of operators will be used for moving the rams between their inner and outer positions.

As shown in FIG. 2, the left-hand ram 24A includes a body 30A which, as above described, has an outer cross section which is adapted to fit closely within the left-hand guideway 23, and a left-hand blade 31A, which is adapted to be removably secured to the ram body by bolts 32 which pass through holes in the body and into threaded bolt holes 33 in the blade. For this purpose, and as best shown, for example, in FIG. 4B, the outer end 34 of the blade opposite its inner cutting edge 35 is rounded to fit against a similarly rounded, inwardly facing surface 34A on the outer end of a slot in the outer end of a recess in the front end of the body 30A. The outer end of the lower face of the blade seats upon a shelf 35C at the outer end of the slot formed in a recess 36 intermediate inwardly extending arms 36A on the lower portion of the body beneath an overhanging upper portion of the body on opposite sides of the recess.

A recess 37 is formed in the top overhang of the body to receive a top packing 37A of rubber having inwardly extending ends 37B which fit within correspondingly shaped ends 37C of the groove along the sides of the ram body. When the packing is so placed, pins 38 on the lower sides of the inner ends of the top packing fit within holes 39 formed in the recess.

The ram also includes left- and right-hand side packers 41 and 42, respectively, whose side edges are supported on shelves 43A and 44A on the top surfaces of the elongated portions of the ram body and beneath a corner of the overhanging portion of the ram adjacent a cut out corner 36C above the side packers.

As will be better understood from the description to follow, rods 45 extending from the outer ends of the side packers are received in holes 46 formed in the ram body to intersect with the vertical holes 39 for receiving the pins 38. Thus, the rods have slots 46A into which the pins 38 move when the side packers have been assembled on the ram bodies and the top packing is then installed to prevent removal of the side packers.

In addition, the top blade 31A has a groove 47 formed in its lower side face and made up of left- and right-hand segments which extend inwardly toward one another at their inner ends to form a "V" oppositely opposed to the "V" of the cutting edge 35 of the blade. Each of these segments of the groove is dovetailed to receive lateral seal strips 48 in position to sealably engage the upper face of the blade of the right-hand ram blade, as will be described to follow. Additionally, there is a rear seal strip 49 which is adapted to fit within a half round at the upper rear edge of the blade 31 and thus seal with adjacent surfaces of the ram body in a manner which should be better understood from the description to follow. This of course permits the blade to be replaced from time to time in that it provides a seal through which fluid may otherwise leak between the blade and ram body.

Figure 3:
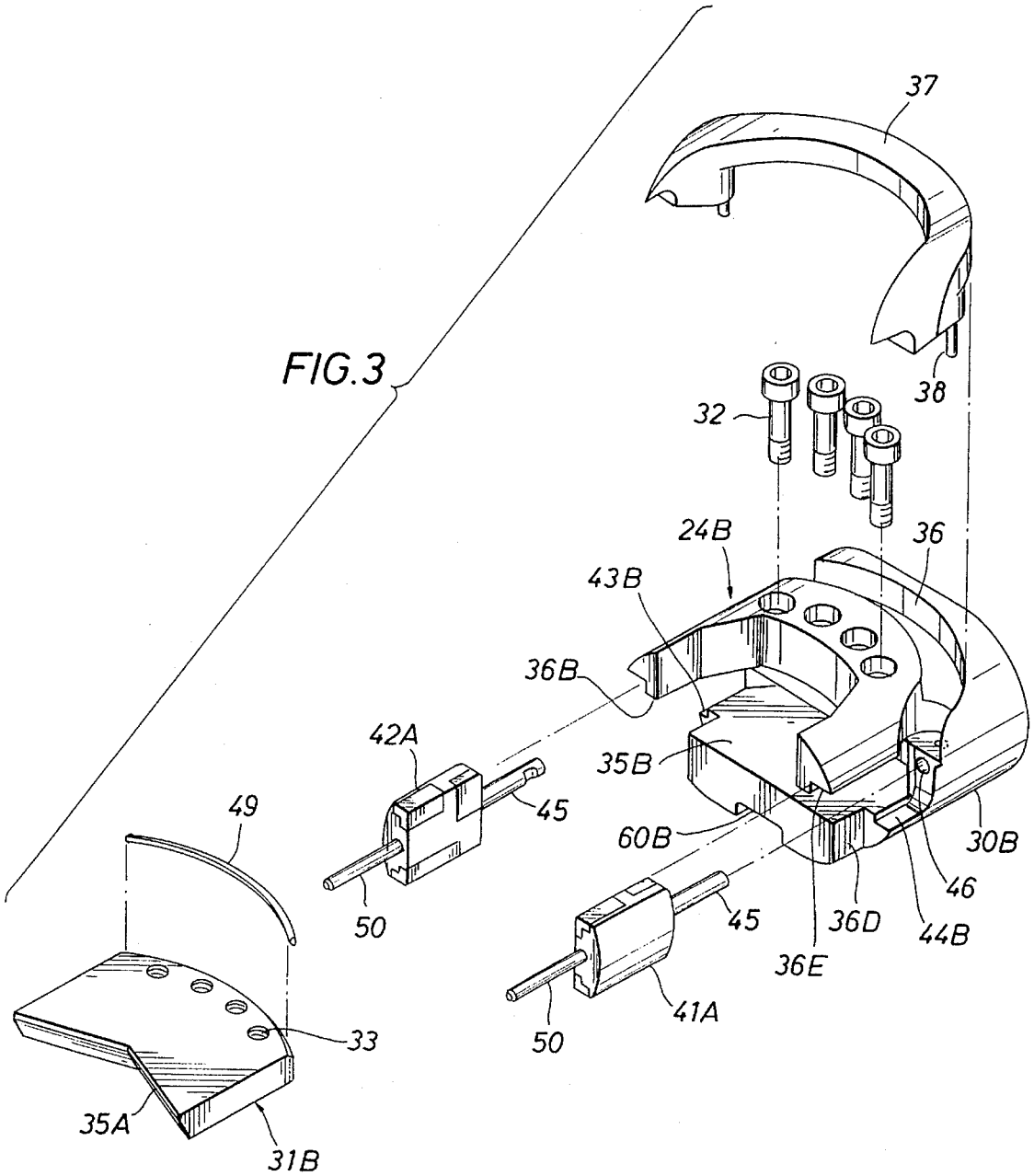
FIG. 3 is an enlarged exploded view of the right-hand ram of the preventer of FIG. 1.

The right-hand ram 24B shown in FIG. 3 is similar in basic construction to the left-hand ram 24A in that it includes a shear blade 31B mounted on the ram body 30B by means of bolts 32 extendable through bolt holes in the top side of the ram body and into threaded holes 33 in the top side of the removable blade 31B when the latter is mounted on the ram body. In this case, however, the lower shear blade 31B will, during the shearing of an object within the wellbore, pass beneath the upper blade of the left-hand shear ram, to move its front end into pocket of the left-hand ram in which the outer end of its lower face is supported on a shelf 35C at the outer end of the rear end of recess 36A in the upper front face of the ram body and the opposite sides of its lower face are supported on rails on opposite sides of the recess on the inner side of the side packers.

More particularly, the upper inward extensions on opposite sides of the recess 36B of the right-hand ram body move along side surfaces on the notched portion 36C of the left-hand ram body which overhangs the recess 36A, while the lower inward extensions on opposite sides of the recess 36A on the front end of the left-hand ram move into positions close to notches in the corners of the inner end of the shelf on the lower side of the recess 36B. Thus, as can be seen from the drawings, the overhanging portion of the left-hand ram has a notch 36C to receive the inward extensions of the right-hand ram, while the inner end of the shelf has a notch 36D to receive the inner ends of the extensions of the left-hand ram body.

Like the body of the left-hand ram, the right-hand ram body has a groove 36 formed in its top side to receive a top seal 37 of the packing and holes which receive downwardly extending pins 38 of the top seal. In like manner, right- and left-hand side packers 42A and 41A are supported on the right- and left-hand sides, respectively, of the ram body 30B with their inner ends positioned to engage the inner ends of the side packers 41 and 42, respectively, as the rams move to their inner positions. Thus, similarly to those of the left-hand ram, the bottom surfaces of the side packers are supported on shelves 43B and 44B on opposite sides of the ram body, while the top surfaces 36E on the under sides of the inward extensions of the right-hand ram on opposite sides of the recess 36B are disposed adjacent the upper sides of the side packers.

As in the case of the side packers of the left-hand ram, side packers 41A and 41B carry pins 45 which extend from their outer ends for moving into holes 46 in the vertical faces of the ram body against which the outer ends of the side packers and which intersect vertical holes in the ends of the recess 36 for receiving the pins 38, thus permitting the side packers to be held in place upon installation of top packing.

Thus, the top face of the lower, right-hand shear blade is adapted to be moved closely beneath the lower side of the top blade of the left-hand ram as the rams are moved inwardly. In like manner, the V-shaped shear edge 35 across the inner end of the left-hand blade is opposed to the "V" shaped edge 35A of the right-hand blade. Thus, as will be described in connection with other figures of this application, the outer ends of the shear edges of the blades will initially move past one another to form a continually decreasing diamond-shaped opening in which the object to be sheared is contained, whereby, the overlapping V-shapes of the blades keep the object from moving outwardly of the blades.

As the top face of the lower blade moves beneath the lower face of the upper blade, its shear edge will approach cross seal strips 48 carried with groove 47 which forms a "V" generally corresponding to that of the shear edge of the right-hand ram. As will be described to follow, the top face of the lower blade just rearwardly of its shearing edge will move initially beneath the seal strip to form a seal between the blades when the rams have moved to their inner positions.

As shown in FIG. 3, pins 50 extend from the front end of each side packer of the right-hand ram in position to be received within sockets 51 in the front end of the side packers of the left-hand ram. More particularly, and as will be apparent from the description to follow, the pins are of such length as to begin to enter the sockets as the side edges of the blades begin to overlap and the inner ends of the ram bodies begin to move into the bore 22 of the preventer body, whereby the cutting edges as well as the sides of the blades are in alignment with one another as the rams continue to be moved toward their inner positions. Also, and as well be better understood from the description to follow, since the pins are disposed on the outer sides of the blades, they together with the overlapping side edges of the blade prevent the tubing or other objects from moving outwardly of the outer ends of the cutting blades during inward movement of the rams, and thus prevent them from being caught between the sides of the blades and the bore of the preventer housing, which of course would interfere with full closure of the rams as the inner ends of the rams move together.

With reference now to the more detailed drawings, and in particular FIGS. 4, 4A, 4B, 4C and 4D, the rams are shown in their outer positions within the guideways 23 of the preventer housing and thus in the same positions shown in FIG. 1. As shown in FIG. 4B, the shear edges of both the upper and lower blades are disposed outwardly of the bore 22 so as to not interfere with the object extending therein. At the same time, the other ends of the oppositely disposed V-shapes of the blades narrow the space through which an object would have to pass into either of the guideways outside the bore. This is of course supplemented by the extension of the pins on the inner end of the outer sides of the right-hand ram inwardly past the shear edge of the right-hand blade.

As shown in FIGS. 4, 4A and 4B, as well as in FIGS. 1, 2 and 3, a slot 60A is formed in the bottom of the body of the left-hand ram, and a slot 60B is formed in the bottom of the body of the right-hand ram to connect the front end of each ram, and thus the bore through the preventer, with the rear end of each ram. Thus, mud and other fluids may pass from the bore into the guideway behind each ram to act over an area on the outer ends of both rams when closed to enhance their sealing engagement with one another.

As can be seen in FIGS. 4 and 4B, the notch formed in the inner corner of the overhanging portions of the body of the left-hand ram provides a pair of end surfaces 62 intersecting a pair of side surfaces 63. These side surfaces are adapted to receive the side surfaces 64 on each inner end of the overhanging portion of the body of the right-hand ram as the rams move to their inner positions as shown in FIGS. 5A to 5C, 6A to 6C, and 7A to 7C. More particularly, the end surface 62 on the body of the left-hand ram will be spaced slightly from the end surface 65 of the inwardly extending portions of the body of the right-hand ram, when the rams are moved to the inner position, so that the inner ends of the side packers may move into tight sealing engagement with one another.

As also shown in these drawings, the rear end of the upper blade 30A is received closely within a slot extending rearwardly from the recess 36A in the front end of the left body, in which position its bolt holes are aligned with the bolts 32 for connecting the blade to the ram body, and the corner seal strip 49 is tightly held in place to seal between the blade and slot from one side to the other of the pocket and thus from one side packer to the other side packer. As can best be seen from FIG. 4B, the strip and the outer end of this recess against which it is held are arcuate so as to be disposed rearwardly of the bolt holes and yet engage at its opposite ends with the inner side of the side packers.

As previously described, and as shown each of the right- and left-hand side packers 41A and 42A of the right-hand ram is received upon a ledge 43A and 44A of the opposite sides of the ram body which is at a slightly lower level than the surface 35B over which the lower sides of the right-hand blades 31B are adapted to move as the rams are moved to their inner positions and as shown in FIGS. 7C and 7D. Thus, as the rams are moved to their inner positions, the oppositely facing inner sides of the side packers 42A and 41A of the right-hand ram move over the opposite sides of the upper blade 30A, while the side edges of the lower blade carried by the right-hand ram are moved between the inner sides of the side packers 41 and 42 carried by the body of the left-hand ram.

As shown in FIGS. 4A and 4B, the ram packing of the right-hand ram also includes a cross seal strip 49, which may be identical to that one carried by the left-hand ram, for disposal within a half round on the upper outer end of the blade for engaging the inner sides of the side packers 41A and 42A to form a continuous seal between the blades and ram body from one packer to another. As shown, this blade also curves outwardly of the bolts which connect the lower blade to the body of the right-hand ram.

As previously described, and as best shown in FIG. 4B, the pins 50 are formed on the inner ends of the rods 45 of the right-hand side packers which are received within holes 46 in the side packer of the right-hand ram body. The sockets 51, on the other hand, are formed on the inner ends of the rods 45 of the side packers of the left-hand packers. As described in connection with FIGS. 2 and 3 and as shown in FIG. 4B, slots 46A formed on the inner sides of the rods 45 to permit the pins 38 on the top seal 37 to pass downwardly through the slots thus locking the side packers on the rams, while permitting them to move rearwardly from the position shown in FIG. 4B as the inner faces of the packer engage and are pressed against one another, as will be described to follow.

Figure 4C:
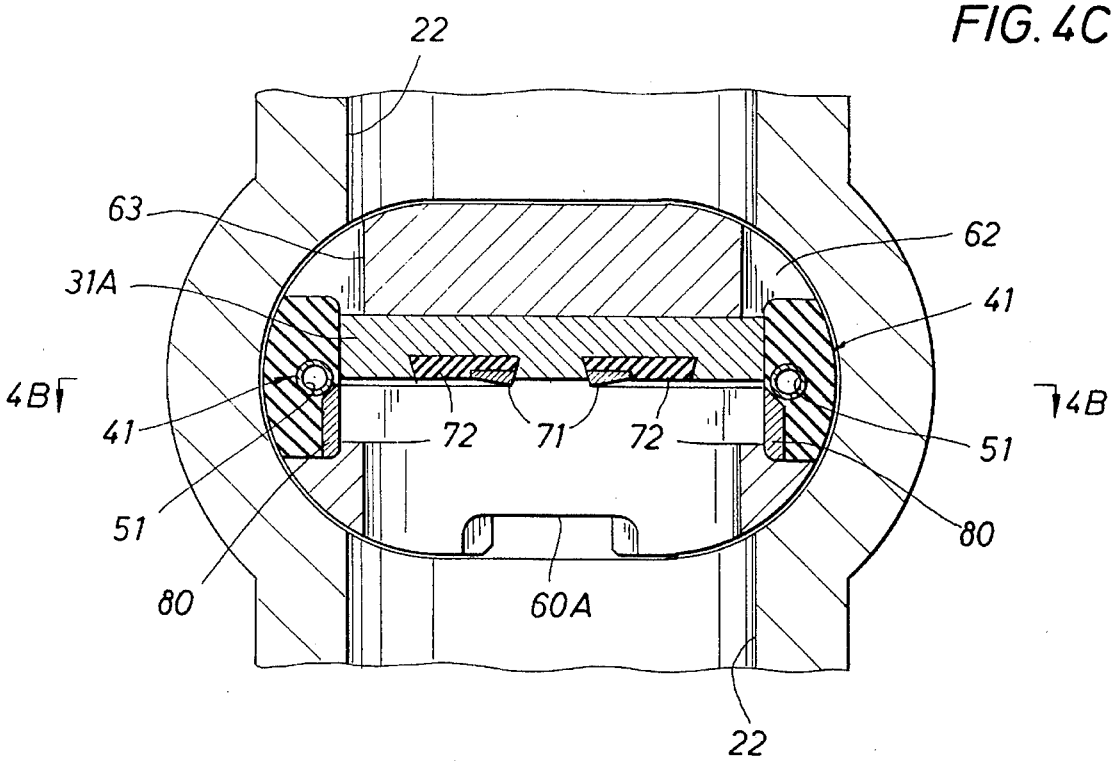
FIG. 4C is a vertical cross-sectional view of the preventer body and left-hand ram, as seen along broken lines 4C—4C of FIG. 4A.
Figure 4D:
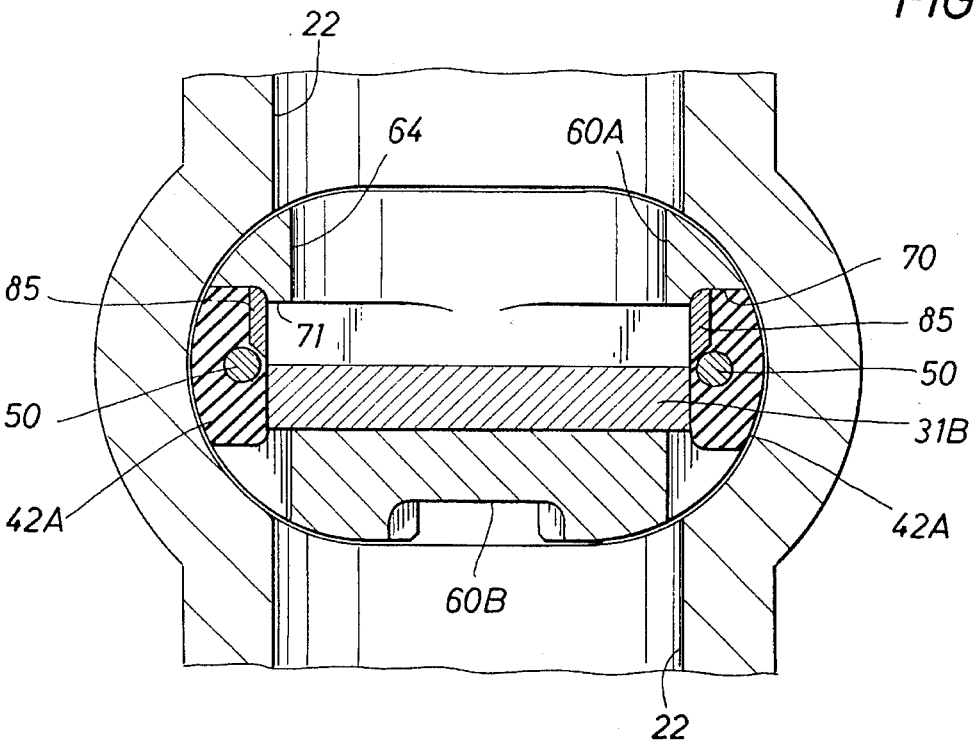
FIG. 4D is a vertical cross-sectional view of the preventer body and right-hand ram, as seen along broken lines 4D—4D of FIG. 4A.

Like the body of the left-hand ram, the inwardly extending portions of the body of the right-hand ram has lower surfaces 36E above the tops of the side packers 41A and 42A, and downwardly facing rails 71 adjacent the opposite sides of slot 60A into which the outer ends of the top of the left-hand ram are adapted to slide, thus forming the pocket for receiving the left-hand blade as it moves over the right-hand blade and between the side packers of the right-hand ram. As best shown in FIGS. 4B and 4D, the lower blade 31B is held along its sides by the inner sides of the side packers of the right-hand ram, while, as shown in FIG. 4B and 4C, the sides of the upper blade are held between the inner sides of the side packers 41 and 42 of the left-hand ram. In each case, the upper and lower inner corners of the top packers are held within recessed corners in the left-hand ram as well as in the right-hand ram, thus firmly holding the top side packers in place when they are connected to the ram body.

As previously described, and as best shown in FIGS. 5, 5A and 5B, as the inner ends of the ram bodies begin to move into the bore 22 in the preventer housing, the pins 50 move into the oppositely facing sockets 51 in the side packers of the left-hand ram. The inner ends of the pins are chamfered to correct for any misalignment of the inner end of the pin and outer end of the socket. This inward movement of the pins not only serves to align the side packers, but also to provide restraint to objects in the bore which might otherwise be prone to extend out between the inner ends of the rams outwardly of the bore. At this time, of course, and as best shown in FIGS. 5, 5A and 5B, the outer ends of the V-shaped shear blades have overlapped one another to form a V-shaped opening between them.

As can be seen from FIG. 5B, at this stage of inward movement of the rams, the tubing or other object in the bore is merely confined between the shear edges of the blades and not moved to any substantial extent from one side to another. Of course, if the object were larger than that shown, the inward movement of the shear edges of the shear blades might have engaged opposite sides of the object and flattened it out to some extent. At this stage of inward movement of the rams, the upper face of the lower blade has not moved beneath the cross seal on the lower face of the top blade, the inner ends of the side packers are still spaced from one another, the pins are not fully received in the sockets, and the inwardly extending portions of the rams bodies have not moved into pockets of the other ram body.

FIGS. 6, 6A and 6B show the rams moved further inwardly to positions in which the apices of the V-shaped shear edges of the blades have crossed one another to shear the object extending within the bore of the preventer. Upon shearing, the upper sheared end of the object has been moved laterally by the V-shaped shear edge of the left-hand blade to a position in which its lower end is within the recess in the body of the right-hand blade above the upper surface of the right-hand shear blade. As can be seen in FIG. 6B, the recess is deep enough to accommodate objects of greater diameter, although the object will probably been narrowed somewhat by having been compressed inwardly along its opposite sides as the blade edges converge from the position of 5B to the position of 6B. Also, of course, this provides additional space into which the lower end of the upper portion of the cut object may move as the apex and the shear edge of the upper ram blade continues to move it to the right.

As shown in FIG. 6A, the lower end of the object has been moved by the shear edge of the lower blade into the recess in the lower portion of the left ram body. Ordinarily, shearing of the object will permit the upper cut end of the lower portion to drop somewhat, thus preventing it from being moved over the cross seal 48. In any case, as previously described, the lower surface of the rubber body 69 of the cross seal is spaced somewhat from the lower face of the upper blade, so that only the metal insert 71 would be engaged by the shear edge of the right-hand blade as it moves thereacross from the position of FIG. 6A to the position of 7A.

When the rams have been moved to the position shown in FIGS. 6A to 6B, the inner ends of the side packers are engaged with one another, the pins 50 are fully inserted into the sockets 51, and the outwardly extending portions of the body of the left-hand ram have been moved into the notches of the lower portion of the right-hand ram, and the inwardly extending portions of the body of the right-hand ram have been moved into the notches of the body of the left-hand ram. For this purpose, the inner ends of the notches and inner ends of the inwardly extending portions are chamfered to allow for any minor misalignment between them which might interfere with continued inner movement of the rams. Up to this point, of course, the inner ends of the side packers have not been engaged and hence there has been no cause for the various portions of the packing including the top and cross packing to be extruded into engagement with opposing surfaces of the guideways or the ram blade.

As shown in FIGS. 7, 7A, 7B, 7C and 7D, the rams have moved to their inner sealing positions in which the inner ends of the side packers are caused to tightly engage one another and thus to cause the rubber bodies thereof to extrude and expand inwardly and outwardly into sealing engagement with the guideways and the sides of the ram blades, and, through the engagement of the side packers with the ends of the top packer to cause it to be extruded tightly into sealing engagement with the oppositely facing upper sides of the guideways. Still further, the extrusion of the side packers transmits force to the ends of the cross seal strip causing it to be moved into tight sealing engagement with the upper face of the lower blade, and movement shear edge and inner portion of the upper face of the right-hand blade will force the metal insert thereof upwardly to enhance extrusion of the rubber body 72 of the cross packer.

As shown in FIG. 7B, as the ends of the side packers are forced against one another, the rods on which the pins and sockets are formed move rearwardly a short distance, as permitted by the elongated slots 46A in the inner sides of the rods through which the pins 38 extend. It will also be noted that the inwardly extending portions on the right-hand ram body have moved further into the notches in the upper portion of the left-hand ram body, while the lower inwardly extending portions on the left-hand ram body have been moved further into the recesses in the lower sides of the right-hand ram body. As best shown in FIGS. 7C and 7D, the side packers are confined top and bottom between the inwardly extending portions of the upper and lower ram bodies, on their inner sides by the side edges of the blades, and on their outer sides by the guideways. As shown in FIGS. 7 and 7B, the inner ends of the inwardly extending portions of the ram bodies are however still spaced slightly from the end surfaces of the notches in the opposite ram body, thus allowing full extrusion of the side packers.

As best shown in FIGS. 8, 8A and 8B, the left-hand side packer 31 comprises a body of rubber in which the rod 45 is carried to dispose the socket 51 of the side packer in position to receive the pins on the other side packer. The inner side as well as the upper and lower edges of the side packer 41 are reinforced with metal plates 80, 81 and 82. The plate 80 is embedded in the inner corner of the inside of the top packer so as to be disposed in a position opposite the right-hand side edge of the right-hand blade as it is moved with the right-hand ram to its inner position. This of course further protects the inner side of the side packer from damage due to the side edge of the lower blade.

The upper and lower reinforcing plates 81 and 82, on the other hand, are L-shaped in cross section and disposed respectively along the upper inner edge and the lower inner edge of the body of rubber. These serve to protect the body of rubber at the corners as it is extruded upon engagement of the ends of the side packers with one another due to sliding with respect to the oppositely facing surfaces of the two ram bodies.

The right side packer of the right-hand blade shown in FIGS. 9A and 9B is also composed of a body of rubber in which the pins 50 are carried on the rods for moving into the sockets 51 in the left-hand top packers. The right-hand top side packer also includes three reinforcing plates 85, 86 and 87, the first of these plates 85 being of generally flat construction and arranged in the upper right-hand corner of the inner side of the side packer so as to be opposite the side edges of the left-hand blade as it moves into place, thus performing a counterpart purpose to the plate 81 of the side packer 41 as the rams move to their inner positions. This of course is also true of the L-shaped reinforcing plates 86 and 87, their functions being analogous to the reinforcing plates 82 and 81 of the side packer 41.

Although the other side packers 42 and 41A on the right-hand side of the left-hand ram and left-hand side of the right-hand ram, respectively, are not shown in detail, it will be understood that each may comprise a reinforced rubber body like that of the other side packers but with the rods reversed. That is, the right side packer 42A is of the same construction as the left side packer of the left-hand ram reversed top for bottom, and with the rod being of a type to have a pin extending from it, rather than a socket formed in it. The same may be said, of course, of the side packings 42 and 41A on the right-hand side of the left end ram and the left-hand side of the right-hand ram. This of course is useful in fabrication of just two types of rubber bodies.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in a blowout preventer having a housing with a bore through which an object may be passed into and out of a well bore and a pair of guideways extending from the bore on apposite sides thereof, an assembly including a pair of rams each having a body closely slidable in a guideway for movement toward and away from the other between inner and outer positions, an upper shear blade carried by the body of a first ram, a lower shear blade carried by the body of a second ram and having a shearing edge on the inner end on its upper face for moving past a shearing edge on the inner end of the lower face of the upper blade to shear an object in bore as the rams are moved from their outer toward inner positions, packing means carried by the ram bodies for sealing engagement with respect to one another and with respect to the guideways in which they slide so as to close off the well bore when the object has been sheared and the ram bodies have been moved further to their inner positions, a pin extending from the inner end of one ram for guidably fitting within a socket opening to the inner end of the other ram as the inner ends of the ram bodies begin to move out of the guideways, a pin extending from the inner end of one of the rams for fitting guidably within a socket opening to the inner end of the other of the rams on opposite sides of the inner ends as the ram bodies begin to move out of the guideways, and means on each ram forming a pocket to closely receive the blade of the other ram following fitting of the pins into the sockets and prior to sealing engagement of the packing means upon continuing movement thereof to their inner positions.

2. As in 1, wherein the pocket of the first ram is formed by the lower face of the upper blade and bottom and inner side surfaces of the body of the first ram, and the pocket of the second ram is formed by the upper face of the lower blade and top and inner side surfaces of the body of the second ram.

3. As in 1, wherein both pins extend from the inner end of both sides of the same ram body and sockets open from the inner side of both sides of the same ram body.

4. As in 1, wherein the packing means includes side packers carried on opposite sides of the blades to slide along the sides of the guideway of the preventer body with their inner ends positioned to engage the inner ends of the side packers of the other ram as the rams move into their inner positions, and a packer carried in the top of each ram body to slide along the top of the guideway and engaging at each end with a side packer, with the pins and sockets extending from and opening to the inner ends of the side packers.

5. As in 4, wherein the inner sides of the side packers of each ram are adjacent the sides of the blade carried by the ram body and in position to closely receive the sides of the blade carried by the other ram body, and the packing means also includes a seal strip extending within a groove in the lower face of the upper blade to seal with the upper face of the bottom blade and at its ends with the side packers on each side of the ram body.

6. As in 4, wherein a rod on the outer end of each pin is mounted within a side packer of the ram, and a rod on the outer end of each socket is mounted within a side packer of the ram, with the outer end of each rod extending into a hole in the ram body and having freedom of outward movement therein as the front faces of the side packers are compressed against one another.

7. For use in a blowout preventer having a housing with a bore through which an object may be passed into and out of a well bore and a pair of guideways extending from the bore on opposite sides thereof, an assembly including a pair of rams each having a body closely slidable in a guideway for movement toward and away from the other between inner and outer positions, an upper shear blade carried by the body of a first ram, a lower shear blade carried by the body of a second ram and having a shearing edge on the inner end on its upper face for moving past a shearing edge on the inner end of the lower face of the upper blade to shear an object in bore as the rams are moved from their outer toward inner positions, packing means carried by the ram bodies for sealing engagement with respect to one another and with respect to the guideways in which they slide so as to close off the well bore when the object has been sheared and the ram bodies have been moved further to their inner positions, said packing means including a pair of side packers carried on opposite sides of the blades to slide along the sides of the guideway of the preventer body with their inner ends positioned to engage the inner ends of the side packers of the other ram as the rams move into their inner positions, and a top packer carried on the top of each ram body to slide along the top of the guideway and engaging at each end with a side packer, a pin extending from the inner end of each of the side packers of one ram for guidably fitting within a socket opening in the inner end of each of the side packers of the other of the rams as the inner ends of the ram bodies begin to move out of the guideways, and means on each ram forming a pocket to closely receive the blade of the other ram following fitting of the pins into the sockets and prior to sealing engagement of the packing means upon continuing movement thereof to their inner positions.

8. As in 7, wherein the pocket of the first ram is formed by the lower face of the upper blade, and inner sides of the side packers and bottom and inner side surfaces of the body of the first ram, and the pocket of the second ram is formed by upper face of the lower ram, and the inner sides of the side packer and top and inner side surfaces of the body of the second ram.

9. As in 7, wherein both pins extend from the inner end of both sides of the same ram body and sockets open from the inner side of both sides of the same ram body.

10. As in 7, including a rod on the outer end of each pin is mounted within each side packer of the one ram, a rod on the outer end of each socket is mounted within each side packer of the other ram, and the outer end of each rod extends into a hole in the ram body and has freedom of outward movement therein as the front faces of the side packers are compressed against one another.

11. As in 10, wherein each top packer has a pair of pins each for extending through a hole in the ram body, and each said top packer pin extends within a slot in the side of the outer end of each rod.

12. As in 7, wherein each side packer includes a body of rubber having a metal plate on its inner side which extends from the upper or lower edge of the body to above the upper or lower surface of the blade to form part of the pocket.

13. For use in a blowout preventer having a housing with a bore through which an object may be passed into and out of a well bore and a pair of guideways extending from the bore on apposite sides thereof, an assembly including a pair of rams each having a body closely slidable in a guideway for movement toward and away from the other between inner and outer positions, an upper shear blade carried by the body of a first ram, a lower shear blade carried by the body of a second ram and having a shearing edge on the inner end on its upper face for moving past a shearing edge on the inner end of the lower face of the upper blade to shear an object in bore as the rams are moved from their outer toward inner positions, packing means carried by the ram bodies for sealing engagement with respect to one another and with respect to the guideways in which they slide so as to close off the well bore when the object has been sheared and the ram bodies have been moved further to their inner positions, packing means on each ram body includes a side packer carried by the ram bodies on opposite sides of the blades to slide along the guideway of the preventer body with its inner end positioned to engage the inner end of the side packer of the other ram as the rams move into their inner positions, and a top packer carried within a groove in the top of each ram body to engage with the side packer at each end, and a seal strip within a groove in the lower side of the upper blade face which extends from one side packer to the other and which has sides tapered toward the face, said groove and strip extending generally parallel to the shear edge of the lower blade and positioned so the upper face of the lower blade passes over it at the end of its inward movement but before the end faces of the side packers engage, and said strip including a body of rubber fitting closely within the groove and having a lower side recessed from the lower blade face, and a metal strip adjacent its rear side and protruding from the lower face of the upper blade so as to extrude the rubber against the face of the lower blade as the shear edge of the other blade moves over it.

14. For use in a blowout preventer having a housing with a bore through which an object may be passed into and out of a well bore and a pair of guideways extending from the bore on opposite sides thereof, an assembly including a pair of rams each having a body closely slidable in a guideway for movement toward and away from the other between inner and outer positions, an upper shear blade carried by the body of a first ram, a lower shear blade carried by the body of a second ram and having a shearing edge on the inner end on its upper face for moving past a shearing edge on the inner end of the lower face of the upper blade to shear an object in bore as the rams are moved from their outer toward inner positions, a pin extending from one side of the inner end of one of the rams for guidably fitting within a socket opening on the same side of the inner end of the other ram, a pin extending from the other side of the inner end of one of the rams for guidably fitting within a socket opening to the same side of the inner end of the other of the rams as the inner ends of the ram bodies begin to move out of the guideways, and means on each ram forming a pocket to closely receive the blade of the other ram following fitting of the pins into the sockets.

15. As in 14, wherein the pocket of the first ram is formed by the lower face of the upper blade and bottom and inner side surfaces of the body of the first ram, and the pocket of the second ram is formed by the upper face of the lower blade and top and inner side surfaces of the body of the second ram.

16. As in 14, wherein both pins extend from the inner end of both sides of the same ram body and the sockets open from the inner side of both sides of the same ram body.

* * * * *

UNITED STATES PATENT AND TRADEMARK OFFICE

CERTIFICATE OF CORRECTION

PATENT NO. : 5,515,916
DATED : May 14, 1996
INVENTOR(S) : Thomas D. Haley

It is certified that error appears in the above-identified patent and that said Letters Patent is hereby corrected as shown below:

The Title page, should be deleted and substitute therefor the attached title page.

Drawings:

DeleteDrawings sheets Figs. 2-11, and substitute therefor the Drawing sheets, consisting of Figs. 2-11, as shown on the attached pages.

United States Patent [19]

Haley

[11] Patent Number: 5,515,916

[45] Date of Patent: May 14, 1996

[54] BLOWOUT PREVENTER

[75] Inventor: Thomas D. Haley, Cypress, Tex.

[73] Assignee: Stewart & Stevenson Services, Inc., Houston, Tex.

[21] Appl. No.: 398,347

[22] Filed: Mar. 3, 1995

[51] Int. Cl.[6] ..... E21B 33/06

[52] U.S. Cl. ..... 166/55

[58] Field of Search ..... 166/55; 251/1.3; 277/129

[56] References Cited

U.S. PATENT DOCUMENTS

| | | | |
|---|---|---|---|
| 2,969,838 | 1/1961 | Wilde | 166/55 |
| 3,561,526 | 2/1971 | Williams, Jr. et al. | 166/55 |
| 3,736,982 | 6/1973 | Vujasinovic | 166/55 |
| 3,817,326 | 6/1974 | Meynier, III | 166/55 |
| 3,946,806 | 3/1976 | Meynier, III | 166/55 |
| 4,132,265 | 1/1979 | Williams, Jr. | 166/55 |
| 4,132,266 | 1/1979 | Randall | 166/55 |
| 4,132,267 | 1/1979 | Jones | 166/55 |
| 4,240,503 | 12/1980 | Holt, Jr. et al. | 166/55 |
| 4,313,496 | 2/1982 | Childs et al. | 166/55 |
| 4,341,264 | 7/1982 | Cox et al. | 166/55 |
| 4,347,898 | 9/1982 | Jones | 166/55 |
| 4,537,250 | 8/1985 | Troxell, Jr. | 166/55 |
| 4,540,046 | 9/1985 | Granger et al. | 166/55 |
| 4,646,825 | 3/1987 | Van Winkle | 166/55 |
| 4,647,002 | 3/1987 | Crutchfield | 251/1.3 |
| 5,064,164 | 11/1991 | Le | 251/1.1 |

*Primary Examiner*—Hoang C. Dang

*Attorney, Agent, or Firm*—Frank S. Vaden; Marvin B. Eickenroht; Jennings B. Thompson

[57] ABSTRACT

There are disclosed rams for blowout preventers having blades on their inner ends in position to shear or sever a pipe or other object extending within the bore of the preventer housing as the rams are moved within guideways intersecting the bore from outer positions, in which the bore is open, to inner positions in which shear edges on opposed faces of the blades pass over another. The rams also carry packing for sealing with respect to the guideways in which they move as well as with respect to one another to close off the bore following shearing of the object.

16 Claims, 12 Drawing Sheets

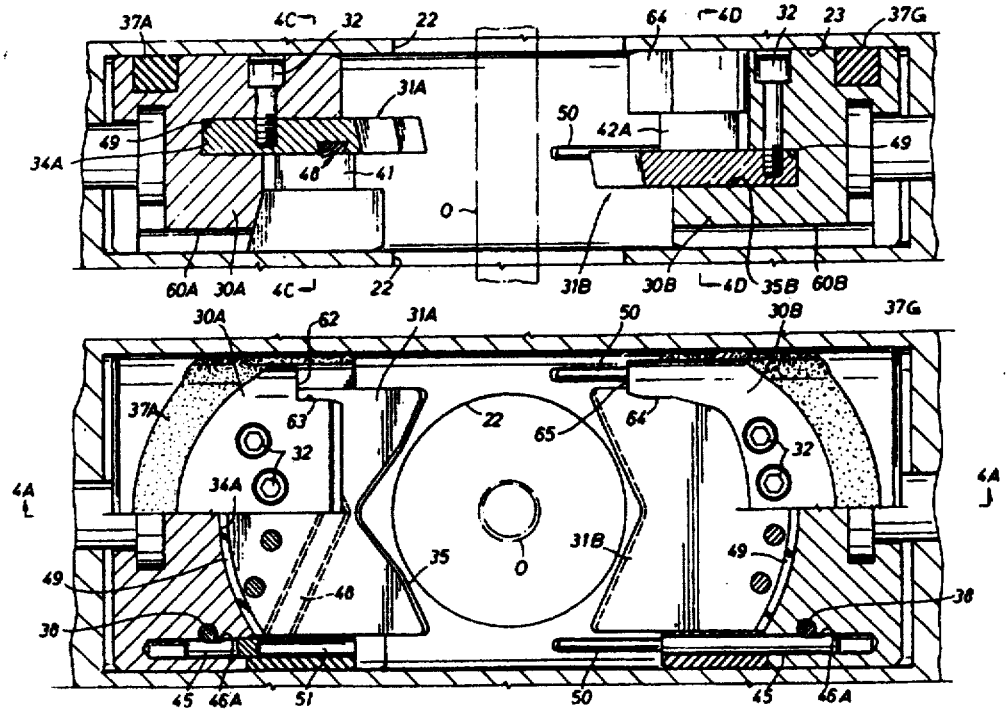

37G
37J
38
32
36H
24B
36G
43B
36E
36B
36I
35B
36I
60B
42A
45
50
49
33
35A
31B
30B
46
44B
36D
36B
36E
45
41A
50

Patent No: 5,515,916

Patent No: 5,515,916

UNITED STATES PATENT AND TRADEMARK OFFICE

CERTIFICATE OF CORRECTION

PATENT NO. : 5,515,916

DATED : May 14, 1996

INVENTOR(S) : Thomas D. Haley

It is certified that error appears in the above-indentified patent and that said Letters Patent is hereby corrected as shown below:

Col. 6, line 22, after "recess" insert --36--.
Col. 6, line 27, after "recess" insert --36--.
Col. 6, line 28, delete "recess" and insert --groove--.
Col. 6, line 56, delete "31" and insert --31A--.

Note that Col. 7 was apparently printed without a line 6, or without some line between 5 and 10. Assume it was printed without a line 6. That is, that line 6 is a blank line.

Col. 7, line 5, delete "35C" and insert --35B--.
Col. 7, line 7, delete "36A" and insert --36H--.
Col. 7, line 9, after "rails" insert --35C--.
Col. 7, line 9, after "recess" insert --36H--.
Col. 7, line 11, prior to "upper" delete "the."
Col. 7, line 11, after "extensions" insert --36B--.
Col. 7, line 12, prior to "recess" delete "the" and insert --a--.
Col. 7, line 12, after "recess" delete "36B" and insert --36H--.
Col. 7, line 14, prior to "recess" delete "the" and insert --a--.
Col. 7, line 14, after "recess" delete "36A" and insert --36--.
Col. 7, line 15, prior to "lower" delete "the."
Col. 7, line 15, after "extensions" insert --36A--.
Col. 7, line 16, delete "36A" and insert --36--.
Col. 7, line 17, after "notches" insert --36D--.
Col. 7, line 18, after "shelf" insert --35B--.
Col. 7, line 18, delete "36B" and insert --36H--.
Col. 7, line 21, after "sions" insert --36B--.
Col. 7, line 21, after "shelf" insert --35B--.
Col. 7, line 22, after "extensions" insert --36A--.
Col. 7, line 25, delete "36" and insert --36G--.
Col. 7, line 26, delete "37" and insert --37G--.

UNITED STATES PATENT AND TRADEMARK OFFICE

CERTIFICATE OF CORRECTION

PATENT NO. : 5,515,916
DATED : May 14, 1996
INVENTOR(S) : Thomas D. Haley

It is certified that error appears in the above-indentified patent and that said Letters Patent is hereby corrected as shown below:

Col. 7, line 36, after "extensions" insert --36B--.
Col. 7, line 37, delete "36B" and insert --36H--.
Col. 7, line 40, delete "41A and 41B" and insert --41 and 42--.
Col. 7, line 43, after "holes" insert --39--.
Col. 7, lines 43 and 44, delete "in the ends of the recess 36."
Col. 7, line 44, after "38" insert --in shaped ends 37C--.
Col. 7, line 45, after "packing" insert --37A--.
Col. 8, line 59, delete "30A" and insert --31A--.
Col. 8, line 60, delete "36A" and insert --36--.
Col. 8, line 61, after "holes" insert --33--.
Col. 9, line 5, delete "43A and 44A" and insert --43B and 44B--.
Col. 9, line 7, delete "surface" and insert --shelf--.
Col. 9, line 13, delete "30A" and insert --31A--.
Col. 9, line 34, delete "seal 37" and insert --seals 37A and 37G respectively--.
Col. 9, line 43, delete "71" and insert --36I--.
Col. 9, line 44, delete "slot 60A" and insert --recess 36H--.
Col. 9, line 50, after "packers" insert --41A and 42A--.
Col. 9, line 53, after "corners" insert --37B and 37J--.
Col. 10, line 4, delete "V-shaped" and insert --diamond-shaped--.
Col. 10, line 40, prior to "rubber" delete "the" and insert --a--.
Col. 10, line 40, delete "69" and insert --72--.
Col. 10, line 41, after "seal" insert --48--.
Col. 11, line 5, delete "strip" and insert --48--.
Col. 11, line 7, after "movement" insert --of the--.
Col. 11, line 9, after "insert" insert --71--.
Col. 11, line 10, delete "packer" and insert --seal 48--.

UNITED STATES PATENT AND TRADEMARK OFFICE

CERTIFICATE OF CORRECTION

PATENT NO. : 5,515,916

DATED : May 14, 1996

INVENTOR(S) : Thomas D. Haley

It is certified that error appears in the above-indentified patent and that said Letters Patent is hereby corrected as shown below:

Col. 11, line 29 (the line is actually the 31st line of the column, but is printed approximately one half line above line designator "30"), delete "31" and insert --41--.

Col. 11, line 48, after "packer" insert --42A--.

Signed and Sealed this

Eleventh Day of November, 1997

*Attest:*

*Attesting Officer*

BRUCE LEHMAN

*Commissioner of Patents and Trademarks*